US010870146B2

(12) United States Patent
Sherman

(10) Patent No.: US 10,870,146 B2
(45) Date of Patent: Dec. 22, 2020

(54) SELF-ACTUATING DEVICE FOR CENTRALIZING AN OBJECT

(71) Applicant: Terves Inc., Euclid, OH (US)

(72) Inventor: Andrew J. Sherman, Mentor, OH (US)

(73) Assignee: Terves, LLC, Euclid, OH (US)

( * ) Notice: Subject to any disclaimer, the term of this patent is extended or adjusted under 35 U.S.C. 154(b) by 55 days.

(21) Appl. No.: 16/129,085

(22) Filed: Sep. 12, 2018

(65) Prior Publication Data

US 2019/0039126 A1 Feb. 7, 2019

Related U.S. Application Data

(60) Division of application No. 15/794,116, filed on Oct. 26, 2017, now Pat. No. 10,758,974, and a (Continued)

(51) Int. Cl.

| | |
|---|---|
| ***E21B 43/267*** | (2006.01) |
| ***B22D 27/08*** | (2006.01) |
| ***B22F 1/00*** | (2006.01) |
| ***C22C 1/03*** | (2006.01) |
| ***C22C 49/14*** | (2006.01) |

(Continued)

(52) U.S. Cl.

CPC ..... *B22D 23/06* (2013.01); *B22D 19/14* (2013.01); *B22D 21/007* (2013.01); *B22D 21/04* (2013.01); *B22D 25/06* (2013.01); *B22D 27/00* (2013.01); *B22D 27/02* (2013.01); *B22D 27/08* (2013.01); *B22D 27/11* (2013.01); *B22F 1/004* (2013.01); *C22C 1/03* (2013.01); *C22C 23/00* (2013.01); *C22C 23/02* (2013.01); *C22C 47/08* (2013.01); *C22C 49/04* (2013.01); *C22C 49/14* (2013.01); *E21B 17/1078* (2013.01); *E21B 43/267* (2013.01); *B22F 2202/01* (2013.01); *B22F 2301/35* (2013.01); *B22F 2304/05* (2013.01); *B22F 2999/00* (2013.01); *C22C 49/02* (2013.01)

(58) Field of Classification Search

None

See application file for complete search history.

(56) References Cited

U.S. PATENT DOCUMENTS

| | | | |
|---|---|---|---|
| 3,180,728 | A | 4/1965 | Pryor et al. |
| 3,445,731 | A | 5/1969 | Saeki et al. |

(Continued)

FOREIGN PATENT DOCUMENTS

| | | |
|---|---|---|
| CN | 101381829 | 3/2009 |
| CN | 102517489 | 6/2012 |

(Continued)

OTHER PUBLICATIONS

Sigworth et al. "Grain Refinement of Aluminum Castings Alloys" American Foundry Society; Paper 07-67; pp. 5-7 (2007).

(Continued)

*Primary Examiner* — Jeffrey D Washville

(74) *Attorney, Agent, or Firm* — Ulmer & Berne LLP

(57) ABSTRACT

The invention is directed to the interventionless activation of wellbore devices using dissolving and/or degrading and/or expanding structural materials. Engineered response materials, such as those that dissolve and/or degrade or expand upon exposure to specific environment, can be used to centralize a device in a wellbore.

36 Claims, 13 Drawing Sheets

Related U.S. Application Data continuation-in-part of application No. 14/940,209, filed on Nov. 13, 2015, now Pat. No. 10,106,730, and a continuation-in-part of application No. 15/294,957, filed on Oct. 17, 2016, now Pat. No. 10,625,336, which is a division of application No. 14/627,236, filed on Feb. 20, 2015, now Pat. No. 9,757,796, application No. 16/129,085, which is a continuation-in-part of application No. 15/641,439, filed on Jul. 5, 2017, now Pat. No. 10,329,653, which is a division of application No. 14/689,295, filed on Apr. 17, 2015, now Pat. No. 9,903,010.

(60) Provisional application No. 62/416,872, filed on Nov. 3, 2016, provisional application No. 62/080,448, filed on Nov. 17, 2014, provisional application No. 61/942,879, filed on Feb. 21, 2014, provisional application No. 61/981,425, filed on Apr. 18, 2014.

(51) Int. Cl.

| | |
|---|---|
| ***B22D 23/06*** | (2006.01) |
| ***B22D 19/14*** | (2006.01) |
| ***C22C 49/04*** | (2006.01) |
| ***C22C 47/08*** | (2006.01) |
| ***C22C 23/02*** | (2006.01) |
| ***C22C 23/00*** | (2006.01) |
| ***B22D 27/11*** | (2006.01) |
| ***B22D 27/02*** | (2006.01) |
| ***B22D 27/00*** | (2006.01) |
| ***B22D 25/06*** | (2006.01) |
| ***B22D 21/04*** | (2006.01) |
| ***B22D 21/00*** | (2006.01) |
| ***E21B 17/10*** | (2006.01) |
| *C22C 49/02* | (2006.01) |

(56) References Cited

U.S. PATENT DOCUMENTS

| | | | |
|---|---|---|---|
| 4,264,362 | A | 4/1981 | Serveg et al. |
| 4,875,948 | A | 10/1989 | Vemecker |
| 5,106,702 | A | 4/1992 | Walker et al. |
| 6,422,314 | B1 | 7/2002 | Todd et al. |
| 6,444,316 | B1 | 9/2002 | Reddy et al. |
| 6,527,051 | B1 | 3/2003 | Reddy et al. |
| 6,554,071 | B1 | 4/2003 | Reddy et al. |
| 6,737,385 | B2 | 5/2004 | Todd et al. |
| 7,647,964 | B2 | 1/2010 | Akbar et al. |
| 7,999,987 | B2 | 8/2011 | Dellinger et al. |
| 8,211,247 | B2 | 7/2012 | Marya et al. |
| 8,211,248 | B2 | 7/2012 | Marya |
| 8,211,331 | B2 | 7/2012 | Jorgensen et al. |
| 8,327,931 | B2 | 12/2012 | Agrawal et al. |
| 8,403,037 | B2 | 3/2013 | Agrawal et al. |
| 8,413,727 | B2 | 4/2013 | Holmes |
| 8,425,651 | B2 | 4/2013 | Xu et al. |
| 8,485,265 | B2 | 7/2013 | Marya et al. |
| 8,528,633 | B2 | 9/2013 | Agrawal et al. |
| 8,573,295 | B2 | 11/2013 | Johnson et al. |
| 8,631,876 | B2 | 1/2014 | Xu et al. |
| 8,663,401 | B2 | 3/2014 | Marya et al. |
| 8,714,268 | B2 | 5/2014 | Agrawal et al. |
| 8,905,147 | B2 | 12/2014 | Fripp et al. |
| 2002/0121081 | A1 | 9/2002 | Cesaroni et al. |
| 2003/0173005 | A1 | 9/2003 | Higashi et al. |
| 2005/0194141 | A1 | 9/2005 | Sinclair et al. |
| 2006/0175059 | A1 | 8/2006 | Sinclair et al. |
| 2006/0207387 | A1 | 9/2006 | Soran et al. |
| 2007/0181224 | A1 | 8/2007 | Marya et al. |
| 2008/0041500 | A1 | 2/2008 | Bronfin |
| 2009/0116992 | A1 | 5/2009 | Lee |
| 2009/0226340 | A1 | 9/2009 | Marya |
| 2011/0135530 | A1 | 6/2011 | Xu et al. |
| 2011/0221137 | A1 | 9/2011 | Obi et al. |
| 2012/0080189 | A1 | 4/2012 | Marya et al. |
| 2012/0156087 | A1 | 6/2012 | Kawabata |
| 2012/0175134 | A1* | 7/2012 | Robisson ..... E21B 33/1208 166/387 |
| 2012/0177905 | A1 | 7/2012 | Seals et al. |
| 2012/0190593 | A1 | 7/2012 | Soane et al. |
| 2012/0318513 | A1 | 12/2012 | Mazyar et al. |
| 2013/0029886 | A1 | 1/2013 | Mazyar et al. |
| 2013/0032357 | A1 | 2/2013 | Mazyar et al. |
| 2013/0056215 | A1 | 3/2013 | Crews |
| 2013/0068411 | A1 | 3/2013 | Forde et al. |
| 2013/0160992 | A1 | 6/2013 | Agrawal et al. |
| 2013/0168257 | A1 | 7/2013 | Mazyar et al. |
| 2013/0199800 | A1 | 8/2013 | Kellner et al. |
| 2013/0229496 | A1 | 9/2013 | Bang |
| 2013/0233568 | A1* | 9/2013 | Levie ..... E21B 17/1078 166/381 |
| 2013/0261735 | A1 | 10/2013 | Pacetta |
| 2014/0093417 | A1 | 4/2014 | Liu |
| 2014/0190705 | A1 | 7/2014 | Fripp |
| 2014/0202284 | A1 | 7/2014 | Kim |
| 2014/0219861 | A1 | 8/2014 | Han |
| 2014/0236284 | A1 | 8/2014 | Stinson |
| 2015/0102179 | A1 | 4/2015 | McHenry et al. |
| 2015/0299838 | A1 | 10/2015 | Doud |
| 2016/0024619 | A1 | 1/2016 | Wilks |

FOREIGN PATENT DOCUMENTS

| | | |
|---|---|---|
| CN | 102796928 | 11/2012 |
| CN | 103343271 | 10/2013 |
| EP | 2088217 | 8/2009 |
| JP | 2008266734 | 11/2008 |
| JP | 2012197491 | 10/2012 |
| JP | 2013019030 | 1/2013 |
| JP | 2014043601 | 3/2014 |
| WO | 1990002655 | 3/1990 |
| WO | 1992013978 | 8/1992 |
| WO | 2013019410 | 2/2013 |
| WO | 2013019421 | 2/2013 |
| WO | 2013122712 | 8/2013 |
| WO | 201354634 | 10/2013 |

OTHER PUBLICATIONS

Momentive, "Titanium Diborid Powder" condensed product brochure; retrieved from https:/www.momentive.com/WorkArea/DownloadAsset.aspx?id+27489.; p. 1 (2012).

Durbin, "Modeling Dissolution in Aluminum Alloys" Dissertation for Georgia Institute of Technology; retrieved from https://smartech;gatech/edu/bitstream/handle/1853/6873/durbin_tracie_L_200505_phd.pdf> (2005).

Pegeut et al.., "Influence of cold working on the pittng corrosion resistance of stainless steel" Corrosion Science, vol. 49, pp. 1933-1948 (2007).

Elemental Charts from chemicalelements.com; retrieved Jul. 27, 2017.

Song et al., "Corrosion Mechanisms of Magnesium Alloys" Advanced Engg Materials, vol. 1, No. 1 (1999).

Zhou et al., "Tensile Mechanical Properties and Strengthening Mechanism of Hybrid Carbon Nanotubes . . . " Journal of Nanomaterials, 2012; 2012:851862 (doi: 10.1155/2012/851862) Figs. 6 and 7.

Trojanova et al., "Mechanical and Acoustic Properties of Magnesium Alloys . . . " Light Metal Alloys Application, Chapter 8, Published Jun. 11, 2014 (doi: 10.5772/57454) p. 163, para. [0008], [0014-0015]; [0041-0043].

AZoNano "Silicon Carbide Nanoparticles-Properties, Applications" http://www.amazon.com/articles.aspx?ArticleD=3396) p. 2, Physical Properties, Thermal Properties (May 9, 2013).

AZoM "Magnesium AZ91D-F Alloy" http://www.amazon.com/articles.aspx?ArticleD=8670) p. 1, Chemical Composition; p. 2 Physical Properties (Jul. 31, 2013.

(56) References Cited

OTHER PUBLICATIONS

Elasser et al., "Silicon Carbide Benefits and Advantages . . . " Proceedings of the IEEE, 2002; 906(6):969-986 (doi:10.1109/JPROC.2002.1021562) p. 970, Table 1.
Lan et al., "Microstructure and Microhardness of SiC Nanoparticles . . . " Materials Science and Engineering A; 386:284-290 (2004).
Casati et al., "Metal Matrix Composites Reinforced by Nanoparticles", vol. 4:65-83 (2014).

* cited by examiner

HIGHLIGHTED IN SITU FORMED PARTICLES

SELF-ACTUATING DEVICE FOR CENTRALIZING AN OBJECT

The present invention is a divisional application of U.S. application Ser. No. 15/794,116 filed Oct. 26, 2017, which in turn claims priority on U.S. Provisional Application Ser. No. 62/416,872 filed Nov. 3, 2016, which is incorporated herein by reference.

The present invention is a continuation-in-part of U.S. patent application Ser. No. 14/940,209 filed Nov. 13, 2015, which in turn claims priority on U.S. Provisional Patent Application Ser. No. 62/080,448 filed Nov. 17, 2014, which are incorporated herein by reference.

The present invention is also a continuation-in-part of U.S. application Ser. No. 15/294,957 filed Oct. 17, 2016, wherein in turn is a divisional of U.S. application Ser. No. 14/627,236 filed Feb. 20, 2015, now U.S. Pat. No. 9,757,796, which in turn claims priority on U.S. Provisional Application Ser. No. 61/942,879 filed Feb. 21, 2014, which are incorporated herein by reference.

The present invention is also a continuation-in-part of U.S. application Ser. No. 15/641,439 filed Jul. 5, 2017, wherein in turn is a divisional of U.S. patent application Ser. No. 14/689,295 filed Apr. 17, 2015, (now U.S. Pat. No. 9,903,010) which in turn claims priority on U.S. Provisional Patent Application Ser. No. 61/981,425 filed Apr. 18, 2014, which are incorporated herein by reference.

FIELD OF THE INVENTION

The present invention is directed to centralizers for use in drilling and completion operations, and particularly to centralizer devices which employ interventionless mechanisms to deploy and/or retract a tube, liner, casing, etc. in a drilling or well operation.

BACKGROUND OF THE INVENTION

Centralizers are often employed in oilfield and related industries where controlled positioning of a device within a well may be of importance. A well is any boring through the earth's surface that is designed to find and acquire liquids and/or gases. Wells for acquiring oil are termed "oil wells." A well that is designed to produce mainly gas is called a "gas well." Typically, wells are created by drilling a bore, typically 5 inches to 40 inches (12 cm to 1 meter) in diameter, into the earth with a drilling rig that rotates a drill string with an attached bit. After the hole is drilled, sections of steel pipe, commonly referred to as a "casing" and which are slightly smaller in diameter than the borehole, are dropped "downhole" into the bore for obtaining the sought after liquid or gas.

The difference in diameter of the wellbore and the casing creates an annular space. When completing oil and gas wells, it is important to seal the annular space with cement. This cement is pumped in, often flushing out drilling mud, and allowed to harden to seal the well. To properly seal the well, the casing should be positioned so that it is in the middle or center of the annular space. The casing and cement provides structural integrity to the newly drilled wellbore in addition to isolating potentially dangerous high pressure zones from each other and from the surface. Thus, centralizing a casing inside the annular space is critical to achieve a reliable seal and, thus, good zonal isolation. With the advent of deeper wells and horizontal drilling, centralizing the casing has become more important and more difficult to accomplish.

Additionally, in the case of a hydrocarbon well, there may arise the need to deliver a downhole tool several thousand feet down into the well for performance of an operation. In performing the operation, it may be preferable that the tool arrive at the operation site in a circumferentially centered manner (with respect to the diameter of the well). Therefore, a centralizer may be associated with the downhole tool in order to ensure its circumferentially-centered delivery to the operation site. This may be especially beneficial where the well is of a horizontal or other configuration presenting a challenge to unaided centralization.

Centralization of one or more components of a well may be advantageous for a host of other different types of operations. In many operations, the vertical alignment of multiple separately delivered downhole tools may be beneficial. In this manner, centralization of such tools at an operation site provides a known orientation or positioning of the tools relative to one another. This known orientation may be taken advantage of where the tools are to interact during the course of the operation, for example, where one downhole tool may be employed to grab onto and fish out another. Additionally, a host of other operations may benefit from the circumferentially-centered positioning of a single downhole tool. Such operations may relate to drilling performance, oil well construction, and the collection of logging information, to name a few.

A traditional method to centralize a casing is to attach centralizers to the casing prior to its insertion into the annular space. Traditional centralizers are commonly secured at intervals along a casing string to radially offset the casing string from the wall of a borehole in which the casing string is subsequently positioned. Most traditional centralizers have wings or bows that exert force against the inside of the wellbore to keep the casing somewhat centralized. The centralizers generally include evenly-spaced arms or ribs that project radially outwardly from the casing string to provide the desired offset. The radially disposed arms or ribs are biased outwardly from a mandrel or other supporting body in order to contact sides of the well wall and, thus, centrally positioning the supporting body. Centralizers ideally center the casing string within the borehole to provide a generally continuous annulus between the casing string and the interior wall of the borehole. This positioning of the casing string within a borehole promotes uniform and continuous distribution of cement slurry around the casing string during the subsequent step of cementing the casing string in a portion of the borehole. Uniform cement slurry distribution results in a cement liner that reinforces the casing string, isolates the casing from corrosive formation fluids, prevents unwanted fluid flow between penetrated geologic formations, and provides axial strength. Unfortunately, these centralizers increase the profile of the casing, thereby causing increased resistance and potential snagging during casing installation.

A bow-spring centralizer is a common type of centralizer that employs flexible bow-springs as the ribs. Bow-spring centralizers typically include a pair of axially-spaced and generally aligned collars that are coupled by multiple bow-springs. The bow-springs expand outwardly from the axis of the centralizer to engage the borehole sidewall to center a pipe received axially through the generally aligned bores of the collars. Configured in this manner, the bow-springs provide stand-off from the borehole and flex inwardly as they encounter borehole obstructions (such as tight spots or protrusions into the borehole) as the casing string is installed into the borehole. Elasticity allows the bow-springs to spring back to substantially their original shape after passing an obstruction to maintain the desired stand-off between the casing string and the borehole.

Unfortunately, the delivery of a downhole tool through the use of a centralizer is prone to inflict damage at the wall of the well by the radially disposed arms of the centralizer. This is because the centralizer is configured with arms reaching an outer diameter capable of stably supporting itself within wider sections of the well. For example, the centralizer may reach a natural outer diameter of about 13 inches for stable positioning within a 12 inch diameter section of a well. However, the centralizer is generally a passive device with arms of a single size that are biased between the support body and the well wall. Therefore, as the diameter of the well becomes smaller, the described arms (often of a bow-spring configuration) are forced to deform and compress to a smaller diameter as well. For example, the same 12 inch diameter well may become about 3 inches in diameter at some point deeper within the well. This results in a significant amount of compressive force to distribute between the arms and the wall of the narrowing well. That is, as the bowed arms become forced down to a lower profile by the narrowing well wall, more force is exerted on the well wall, thereby potentially resulting in damage to the well wall and/or the centralizer.

The above described exertion of force can become quite extreme depending on the configuration and dimensions of the arms and the extent of the well's narrowing. As a result, such bow-spring arms may prematurely wear out or cause significant damage to the well wall as the centralizer is forced through narrower well sections, or may require excessive amounts of force to push down long laterals. Many of these narrower well sections may have no relation to the actual operation site. Thus, the damage to the well wall and/or centralizer may occur in sections of the well where centralization by the centralizer is unnecessary. Furthermore, due to the forces between the centralizer and the well wall, a significant amount of additional force, for example, through coiled tubing advancement, may be required. This may leave coiled tubing, the centralizer, and even the well itself susceptible to damage from application of such greater forces thereupon. This excessive force may restrict the ability to unstick pipe or liner, cause significant problems and non-productive time, and potentially require using smaller diameter casing or tubing to be used, thereby restricting well output.

As an alternative to the passive centralizers described above, active centralizers such as tractoring mechanisms or other devices capable of interactive or dynamic arm diameter changes may be employed. However, these types of devices are fairly sophisticated and generally require the exercise of operator control over the centralizer's profile throughout the advancement or withdrawal of the device from the well. Thus, such mechanisms are prone to operator error which may lead to well damage from the above described passive centralizer. Furthermore, rather than reliance on the radially extending natural force of a bowing or similar arm, such devices may require the maintenance of power to the arms at all times in order to attain biasing against the well wall with the arms. Therefore, unlike a passive centralizer, the active centralizer may fail to centralize when faced with a loss of power.

Attempts have been made to develop low-profile, deployable centralizers that can be added to the outside of the casing/pipe. These are designed to reduce friction and snagging due to the fact that the supports or bows are retracted until in their final position. The challenge in developing an effective deployable centralizer is to make it as low profile as possible, actuate deployment upon demand, and to overcome de-centralizing force.

Centralizers are usually assembled at a manufacturing facility and then shipped to the well site for installation on a casing string. The centralizers, or subassemblies thereof, may be assembled by welding or by other means such as displacing a bendable and/or deformable tab or coupon into an aperture to restrain movement of the end of a bow-spring relative to a collar. Other centralizers are assembled into their final configuration by riveting the ends of a bow-spring to a pair of spaced apart and opposed collars. The partially or fully assembled centralizers may then be shipped in trucks or by other transportation to the well site.

U.S. Pat. No. 6,871,706 (incorporated herein by reference) discloses a centralizer that requires a step of bending a retaining portion of the collar material into a plurality of aligned openings, each to receive one end of each bow-spring. This requires that the coupling operation be performed in a manufacturing facility using a press. The collars of the prior art centralizer are cut with a large recess adjacent to each set of aligned openings to accommodate passage of the bow-spring that is secured to the interior wall of the collar. The recess substantially decreases the mechanical integrity of the collar due to the removal of a large portion of the collar wall to accommodate the bow-springs. The collars of the casing centralizer disclosed in this patent also require several additional manufacturing steps, including the formation of both internal and external (alternating) upsets in each collar to form the aligned openings for receiving and securing bow-springs, a time-consuming process that further decreases the mechanical integrity of the collar.

U.S. Pat. No. 4,545,436 and Great Britain Patent No. 2242457 (incorporated herein by reference) both disclose casing centralizers having a plurality of bow-springs which are connected at either end to the first and second collars. As described in U.S. Pat. No. 4,545,436, the bow-springs are connected to the collars using rivets or by welding. Conversely, in Great Britain Patent No. 2242457, the bow-springs are connected using nuts and bolts.

Additional centralizers are discussed in U.S. Pat. Nos. 2,654,435; 3,746,092; 4,776,397; 5,379,838; 6,457,519; 7,140,431; 7,775,272; 7,857,063; 8,235,106; 8,360,161; and 9,458,672, all of which are incorporated herein by reference.

Improved centralizers and methods continue to be sought, particularly in view of the limitations of the prior art and the need for better and stronger centralizers. Considerations for the development of new centralizers and new methods of assembling the centralizers include manufacturing costs, shipping costs, the costs associated with installing the centralizers onto pipe strings, and the ease of running the pipe string into the well.

SUMMARY OF THE INVENTION

The present invention relates to the construction of subterranean wells, particularly to methods and constructions for centering components within a well, particularly an oil or gas well, more particularly to centralizers for use in drilling and completion operations, and still more particularly to centralizer devices which employ interventionless mechanisms to deploy and retract a tube, liner, casing, etc. in a drilling or well operation.

Dissolvable and/or degradable materials have been developed over the last several years. This technology has been developed in accordance with the present invention to enable the interventionless activation of wellbore devices using such materials. One non-limiting application is devices for centralizing a casing or liner string. Using engineered response materials (such as those that dissolve and/or degrade and/or expand upon exposure to specific environment), a centralizing device can be run in the closed position with low force and without problems of sticking. After the centralizer is positioned in a desired location in the wellbore, the centralizer device can be activated to cause expand components on the centralizer to deploy to cause centralization of a tube, liner, casing, etc. in the wellbore.

The present invention uses materials that have been developed to react and/or respond to wellbore conditions. These materials can be used to create various responses in a wellbore such as dissolution, structural degradation, shape change, expansion, change in viscosity, reaction (heating or even explosion), change in magnetic or electrical properties, and/or others of such materials. These responses can be triggered by a change in temperature from the surface to a particular location in the wellbore, by a change in pH about the material, controlling salinity about the region of the material, by the addition or presence of a chemical (e.g., $CO_2$, etc.) to react with the material, and/or by electrical stimulation (e.g., introducing an electrical current, current pulse, etc.) to the material, among others. These materials can be used in conjunction with a centralizer to activate and/or deactivate the centralizer.

When structural expandable materials are used with a centralizer, these expandable structural materials can be used to apply forces to the bow structure of a centralizer, thereby causing such bow structures to deploy once the centralizer is placed in a desired position in the wellbore. Similarly, when a degradable structural material is used with the centralizer, such as, but not limited to, a ring, sleeve, spring, bolt, rivet, bracket, pin, clip, etc., such degradable structural material can be used to retain, compress and/or constrain a centralizer utilizing spring-loaded wings or bows. As used in this application, a degradable material is a material that is dissolvable and/or degradable. In such a configuration, when the degradable structural material is caused to dissolve and/or degrade, thereby removing or weakening the degradable structural material, the spring-loaded wings or bows will be allowed to actuate and deploy on the centralizing device. By using degradable materials on a centralizing device, a novel centralizing device can be created that can be automatically deployed and/or retracted in a controlled manner in a wellbore. As can also be appreciated, after the centralizing device has been deployed, the centralizing device can be caused to be disabled by the degradable structural material. For example, a degradable structural material can be in the form of a retaining pin that can be designed to dissolve and/or degrade to thereby cause the pin to fail, which pin failure causes the spring force on the wings or bows to be reduced or lost. As can be appreciated, many other or additional components of the centralizing device can be formed of a degradable structural material to cause the centralizing device to be activated or deactivated. As can be appreciated, one type of degradable structural material can be used to cause the activation of the centralizing device, and a different degradable structural material can be used to disable or deactivate the centralizing device; however, this is not required.

In one non-limiting aspect of the present invention, there are provided expandable materials on a centralizer device that are attached to a collar in an unexpanded form. When the expandable materials are caused to expand, the expansion of such material causes one or more arms or ribs on the centralizer to move or expand radially to cause centralization of the centralization device in the wellbore. In one non-limiting design, the arms or ribs can be partially or fully formed of the expandable material; however, this is not required.

In another and/or alternative non-limiting aspect of the present invention, the expandable material in the centralizer device is used as a force applier to cause actuation, such as by being inserted under a collar and actuating against a bow spring element, of one or more bow springs to be deployed on the centralizer device. In one non-limiting configuration, the expandable material in the centralizer device is applied as a coating, and/or added as inserts onto the bow element of the centralizer device to cause the bow to bend outward and deploy on the centralizer device when the expandable materials are caused to expand. As can be appreciated, many other configurations can be used on a centralizer device to cause the expandable material to cause centralization of a centralizer device in a wellbore.

In another and/or alternative non-limiting aspect of the present invention, the expandable material in the centralizer device can be caused to shrink after being initially expanded; however, this is not required. In one such application, after the expandable material has been expanded to cause a centralizer device to be centered in a wellbore, the expandable material can be caused to shrink so as to enable the centralizer device to move into a partially or fully retracted or deactivated position to once again move freely in the wellbore. The expandable material can be formed of materials that allow multiple expansion and/or shrinking of the material; however, this is not required.

In another and/or alternative non-limiting aspect of the present invention, the centralizing device can include one or more degradable metals. Such degradable metals on the centralizer device can be used to create a centralizer device that passively activates and/or self-activates in a wellbore when the degradable metals partially or fully dissolve and/or degrade on the centralizer device. In one non-limiting configuration, there is provided a centralizer device that includes one or more precompressed springs which are restrained by one or more degradable metals. When the one or more degradable metals partially or fully dissolves and/or degrades, the one or more precompressed springs are released, thereby causing one or more arms or ribs on the centralizer device to be deployed. In such a configuration, the one or more degradable metals can be in the form of rings, sleeves, restraining blocks, screws, pins, clips, etc.

In another and/or alternative non-limiting aspect of the present invention, a wide variety of mechanisms for harnessing and amplifying the force of the expandable structural materials can be designed to cause the centralization action on a centralizer device. A few non-limiting examples are described in the drawings and the non-limiting embodiments discussed herein; however, these are not limiting mechanisms capable of being used to create centralization force by a centralizing device using expandable or degradable, or other engineered response material.

In summary, there is provided a method and a device for centralizing a well. The centralizing device can be placed/attached to the outside diameter of a well insertion structure such as a tube or other structure that is designed to be inserted into a wellbore, a cavity, a tube or the like. The well insertion structure can optionally have a body that is cylindrical in shape; however, this is not required. The well insertion structure is generally configured to include one or more slats, wings, bows, leaves, ribbons, extensions, and/or ribs; however, this is not required. The one or more slats, wings, bows, leaves, ribbons, extensions, and/or ribs function as radial extensions that are positioned on the outer surface of the body of the well insertion structure. Generally when the one or more slats, wings, bows, leaves, ribbons, extensions, and/or ribs are in a non-deployed position, the one or more slats, wings, bows, leaves, ribbons, extensions, and/or ribs lie flat or semi-flat on the outer surface of the body of the well insertion structure. In such a position, the well insertion structure can be inserted into the wellbore, a cavity, a tube or the like without obstruction by or damage to the one or more slats, wings, bows, leaves, ribbons, extensions, and/or ribs. When the well insertion structure is positioned in a desired location in the wellbore, a cavity, a tube or the like, the one or more slats, wings, bows, leaves, ribbons, extensions, and/or ribs can be caused to move to a partially or fully deployed position. The well insertion structure includes one or more expandable, degradable metals that can be used to cause one or more of the slats, wings, bows, leaves, ribbons, extensions, and/or ribs to partially or fully move to the fully deployed position. The one or more expandable, degradable metals can be controllably caused or activated to change shape, expand, dissolve, degrade, react, degrade, and/or structurally weaken so as to cause the one or more of the slats, wings, bows, leaves, ribbons, extensions, and/or ribs to partially or fully move to the fully deployed position. The activation of the one or more expandable, degradable metals on the centralization device can be caused to be activated or triggered by one or several events (e.g., by a change in temperature from the surface of the wellbore to a particular location in the wellbore; by a change in pH of liquids about the centralization device; the salinity of liquids about the centralization device; the exposure of the one or more expandable, degradable metals to one or more chemicals and/or compounds and/or gasses; application of current and/or voltage to the one or more expandable, degradable metals; exposure of certain types of electromagnetic waves and/or sound waves to the one or more expandable, degradable metals; exposure to certain pressures on the one or more expandable, degradable metals, etc.). When the one or more expandable, degradable metals on the centralization device are caused to be activated or triggered, the one or more expandable, degradable metals on the centralization device cause the one or more of the slats, wings, bows, leaves, ribbons, extensions, and/or ribs to partially or fully move to the fully deployed position. The slats, wings, bows, leaves, ribbons, extensions, and/or ribs can be fully or partially formed of the one or more expandable, degradable metals, and/or can 1) cause the one or more slats, wings, bows, leaves, ribbons, extensions, and/or ribs to partially or fully move to the fully deployed position when the one or more expandable, degradable metals change shape, expand, dissolve, degrade, react, degrade, and/or structurally weaken, and/or 2) release constraints on the one or more slats, wings, bows, leaves, ribbons, extensions, and/or ribs so as to allow the one or more slats, wings, bows, leaves, ribbons, extensions, and/or ribs to partially or fully move to the fully deployed position when the one or more expandable, degradable metals change shape, expand, dissolve, degrade, react, degrade, and/or structurally weaken. In one non-limiting embodiment, the one or more expandable, degradable metals cause the one or more slats, wings, bows, leaves, ribbons, extensions, and/or ribs on the outer surface of the body of the well insertion structure to expand or cause an outer perimeter of the one or more slats, wings, bows, leaves, ribbons, extensions, and/or ribs to move at least about 0.25 inches outwardly from the outer surface of the outer surface of the body of the well insertion structure (e.g., 0.25-20 inches and all values and ranges therebetween). In another non-limiting embodiment, the one or more expandable, degradable metals cause the one or more slats, wings, bows, leaves, ribbons, extensions, and/or ribs on the outer surface of the body of the well insertion structure to expand or cause an outer perimeter of the one or more slats, wings, bows, leaves, ribbons, extensions, and/or ribs to move at least about 0.75 inches outwardly from the outer surface of the outer surface of the body of the well insertion structure. In another non-limiting embodiment, the one or more expandable, degradable metals cause the one or more slats, wings, bows, leaves, ribbons, extensions, and/or ribs on the outer surface of the body of the well insertion structure to expand or cause an outer perimeter of the one or more slats, wings, bows, leaves, ribbons, extensions, and/or ribs to move about 1-20 inches outwardly from the outer surface of the outer surface of the body of the well insertion structure. The expansion of the one or more expandable, degradable metals and/or the outward movement of the one or more slats, wings, bows, leaves, ribbons, extensions, and/or ribs results in the diameter or cross-sectional area of the well insertion structure and thereby centralizes in the wellbore, a cavity, a tube or the like. The expansion and/or movement of the one or more slats, wings, bows, leaves, ribbons, extensions, and/or ribs is generally such that the one or more one or more slats, wings, bows, leaves, ribbons, extensions, and/or ribs engage the inner wall of the wellbore, a cavity, a tube or the like; however, this is not required.

In another and/or alternative non-limiting aspect of the present invention, the well insertion structure includes ribbons that are comprised of a material that is structural and a material that interacts with the wellbore fluid to expand, and wherein the expanding material is on the inner section of the ribbons, and its expansion causes the ribbons to expand or bow radially outward in a controlled manner.

In another and/or alternative non-limiting aspect of the present invention, the well insertion structure includes slats, wings, bows, leaves, ribbons, extensions, and/or ribs that lie flat along the outer surface of the body of the well insertion structure and includes a rod of expanding structural material constrained against a fixed end-ring in an axial slot at the end of the slats, wings, bows, leaves, ribbons, extensions, and/or ribs, and where the expansion of the rod upon interaction with the wellbore fluid causes the ribbon to bow outward from the body of the well insertion structure thereby resulting in the centralizing of the well insertion structure the wellbore, a cavity, a tube or the like.

In another and/or alternative non-limiting aspect of the present invention, the well insertion structure includes slats, wings, bows, leaves, ribbons, extensions, and/or ribs that are spring-loaded and restrained in diameter by a sleeve, locking rings or wire, set screws, pins, or other locking mechanisms, where such sleeves, rings, pins, screws, wire, or other restraint or locking fixture dissolves, degrades and/or weakens upon wellbore exposure, thereby partially or fully removing the restraint and/or weakening the restraint thereby causing the slats, wings, bows, leaves, ribbons, extensions, and/or ribs to bow or extend outward from the body of the well insertion structure.

In another and/or alternative non-limiting aspect of the present invention, the well insertion structure includes slats, wings, bows, leaves, ribbons, extensions, and/or ribs that are partially or fully formed of expandable structural materials, and expand outward due to their inherent growth upon exposure to one or several events (e.g., change in temperature from the surface of the wellbore to a particular location in the wellbore; change in pH of liquids about the centralization device; the salinity of liquids about the centralization device; the exposure of the one or more expandable, degradable metals to one or more chemicals and/or compounds and/or gasses; application of current and/or voltage to the one or more expandable, degradable metals; exposure of certain types of electromagnetic waves and/or sound waves to the one or more expandable, degradable metals; exposure to certain pressures on the one or more expandable, degradable metals, etc.).

In another and/or alternative non-limiting aspect of the present invention, the well insertion structure includes slats, wings, bows, leaves, ribbons, extensions, and/or ribs that are partially or fully formed of materials that are dissolving and/or degrading, such that they remove themselves after a predetermined length of time. Such materials can be triggered or be caused to partially or fully dissolve and/or degrade upon exposure to one or several events (e.g., change in temperature from the surface of the wellbore to a particular location in the wellbore; change in pH of liquids about the centralization device; the salinity of liquids about the centralization device; the exposure of the one or more expandable, degradable metals to one or more chemicals and/or compounds and/or gasses; application of current and/or voltage to the one or more expandable, degradable metals; exposure of certain types of electromagnetic waves and/or sound waves to the one or more expandable, degradable metals; exposure to certain pressures on the one or more expandable, degradable metals, etc.).

In another and/or alternative non-limiting aspect of the present invention, the well insertion structure includes fixed end-rings constraining the slats, wings, bows, leaves, ribbons, extensions, and/or ribs, and wherein the fixed end-rings are partially or fully formed of a degradeable structural material which releases the tension on the slats, wings, bows, leaves, ribbons, extensions, and/or ribs after exposure to one or more events thereby allowing the slats, wings, bows, leaves, ribbons, extensions, and/or ribs on the well insertion structure to move to the partially or fully open position, or move to a closed position.

In another and/or alternative non-limiting aspect of the present invention, the well insertion structure includes a degradable structural material that is coated, which coating can be used to delay the time at which the degradable structural material begins to dissolve and/or degrade, and/or controls when the degradable material begins to dissolve and/or degrade.

In another and/or alternative non-limiting aspect of the present invention, there is provided a method of positioning a well insertion structure in a wellbore, a cavity, a tube or the like that includes the steps of 1) providing a wellbore, a cavity, a tube or the like having a substantially circular sidewall, 2) providing a pipe having a cylindrical sidewall, 3) providing a self-actuating annular well insertion structure that can be attached to the pipe, 4) attaching one or more of the self-actuating annular well insertion structure to the pipe, the outer diameter of the pipe with the attached self-actuating annular well insertion structure is less than the diameter of the wellbore, a cavity, a tube or the like, and wherein when more than one self-actuating annular well insertion structure are attached to the pipe, the self-actuating annular well insertion structures are spaced at specific intervals on the pipe, 5) running the pipe with the one or more self-actuating annular well insertion structures into the wellbore, the cavity, the tube or the like while the self-actuating annular well insertion structures are in an unexpanded position until the self-actuating annular well insertion structures are positioned in a desired position in the cavity, the tube or the like, and 6) allowing or causing the expanding or dissolving and/or degrading of one or more components of the self-actuating annular well insertion structures to cause the self-actuating annular well insertion structures to move to the partially or fully expanded position such that one or more structures on the self-actuating annular well insertion structures contact a sidewall of the cavity, the tube or the like to cause the self-actuating annular well insertion structures to center the pipe in the cavity, the tube or the like, thereby resulting in there being spacing between the pipe and the sidewall of the cavity, the tube or the like. In an optional additional or alternative method, after the self-actuating annular well insertion structures are in the partially or fully expanded position, the self-actuating annular well insertion structures can be caused to move to a partially or fully unexpanded position and/or the self-actuating annular well insertion structures can be caused to degrade and/or dissolve.

In another and/or alternative non-limiting aspect of the present invention, the one or more expanding or degradable components of the self-actuating annular well insertion structure includes reactive particles dispersed in a polymer matrix. In one non-limiting configuration, the reactive particles have a concentration of 20-60 vol. % (and all values and ranges therebetween) in a polymer, and which reactive particles react with water to form oxides, hydroxides, or carbonates and are caused to expand 50 vol. % as compared to the original particle sizes. In another non-limiting configuration, the reactive particles include one or more particles selected from the group consisting of MgO, CaO, CaC, Mg, Ca, Na, Fe, Si, P, Zn, Ti, $Li_2O$, $Na_2O$, borates, aluminosilicates, and/or layered compounds. In another non-limiting configuration, the polymer includes a thermoset or thermoplastic polymer wherein such polymer can include one or more compounds selected from the group of polyesters, nylons, polycarbonates, polysulfones, polyimides, PEEK, PEI, epoxy, PPS, PPSU, and/or phenolic compounds. In another non-limiting configuration, the polymer includes a thermoset or thermoplastic polymer that is capable of maintaining structural load at the wellbore temperature. In another non-limiting configuration, the polymer includes a thermoset or thermoplastic polymer that has a preselected creep rate to relax and remove loading on the ribbon or bow over a period of time. In another non-limiting configuration, the degradable material on the self-actuating annular well insertion structure includes a degradable magnesium alloy. In another non-limiting configuration, the magnesium alloy can be formulated to have a controlled and/or engineered degradation rate at certain wellbore conditions.

In another and/or alternative non-limiting aspect of the present invention, there is provided an expandable material that is used with or in the centralizer, which expandable material uses one or two basic methods to deliver force: 1) use of in situ-thermally activated shape change materials, and 2) use of oxidative reaction of metals with subsequent volumetric expansion. The first technique can involve a reversible martensitic reaction. The second technique can involve reaction with water and/or carbon dioxide to turn metals into oxides, hydroxides, or carbonates (e.g., iron to rust, etc.), with a corresponding expansion of the material. The percent volume expansion is generally at least about 2%, and typically at least about 20%. Generally, the volume expansion is up to about 200% (e.g., 2-200%, 20-200%, 42-141%, etc. and all values and ranges therebetween).

In another non-limiting aspect of the present invention, there is provided an expandable material that is configured and formulated to expand in a controlled or predefined environment. The expandable material has a compressive strength after expansion of at least 2,000 psig. The expandable composite material has a compressive strength after expansion of up to about 1,000,000 psig or more (e.g., 2,000 psig to 1,000,000 psig and all values and ranges therebetween). The expandable material typically has a compressive strength after expansion of at least 10,000 psig, and typically at least 30,000 psig. The compressive strength of the expandable material is the capacity of the expandable material to withstand loads to the point that the size or volume of the expandable material reduces by less than 2%.

In another non-limiting aspect of the present invention, the expandable material includes 10-80% by volume of an expandable material. The expandable material can be formulated to undergo a mechanical and/or chemical change resulting in a volumetric expansion of at least 2% and typically at least 50% (e.g., 2-5000% and all values and ranges therebetween) by reaction and/or exposure to a fluid environment. In one non-limiting arrangement, the expandable material is formulated to undergo a mechanical and/or chemical change resulting in a volumetric expansion of at least 20% by reaction and/or exposure to a fluid environment. In another non-limiting arrangement, the expandable material can include a matrix and/or binder material that is used to bind together particles of the expandable material. The matrix and/or binder material is generally permeable or semi-permeable to water. In one non-limiting arrangement, the matrix and/or binder material is semi-permeable to high temperature (e.g., at least 100° F., typically 100-210° F. and all values and ranges therebetween) and high pressure water (e.g., at least 10 psig, typically 10-10,000 psig and all values and ranges therebetween). The expandable material or the expandable material in combination with the matrix and/or binder material can have a compressive strength before and/or after expansion of at least 2,000 psig, and typically at least 10,000 psig (e.g., 2,000 psig to 1,000,000 psig and all values and ranges therebetween); however this is not required.

In another non-limiting aspect of the present invention, the reaction of the expandable material is selected from the group consisting of a hydrolization reaction, a carbonation reaction, and an oxidation reaction, or combination thereof.

In another non-limiting aspect of the present invention, the expandable material can include one or more materials selected from the group consisting of flakes, fibers, powders and nanopowders; however, this is not required. When the expandable material is combined with a matrix and/or binder material, the expandable material can form a continuous or discontinuous system. When the expandable material is combined with a matrix and/or binder material, the expandable material can be uniformly or non-uniformly dispersed in the matrix and/or binder material.

In another non-limiting aspect of the present invention, the expandable material can include one or more materials selected from the group consisting of Ca, Li, CaO, $Li_2O$, $Na_2O$, Fe, Al, Si, Mg, $K_2O$ and Zn. The expandable material generally ranges in size from about 106 μm to 10 mm.

In another non-limiting aspect of the present invention, the expandable material can include one or more polymer materials; however, this is not required. When the expandable material includes a matrix or binder material, such matrix or binder material can include or be formed of a polymer material. The polymer material can include one or more materials selected from the group consisting of polyacetals, polysulfones, polyurea, epoxys, silanes, carbosilanes, silicone, polyarylate, and polyimide.

In another non-limiting aspect of the present invention, the expandable material can include one or more catalysts for accelerating the reaction of the expandable material; however, this is not required. The catalyst can include one or more materials selected from the group consisting of $AlCl_3$ and a galvanically-active material.

In another non-limiting aspect of the present invention, the expandable material can include strengthening and/or diluting fillers; however, this is not required. The strengthening and/or diluting fillers can include one or more materials selected from the group consisting of fumed silica, silica, glass fibers, carbon fibers, carbon nanotubes and other finely divided inorganic material.

In another non-limiting aspect of the present invention, the expandable material can include a surface coating or protective layer that is formulated to control the timing and/or conditions under which the reaction or expanding occurs; however, this is not required. The surface coating can be formulated to dissolve and/or degrade when exposed to a controlled external stimulus (e.g., temperature and/or pH, chemicals, etc.). The surface coating can be used to control activation of the expanding of the core or core composite. The surface coating can include one or more materials such as, but not limited to, polyester, polyether, polyamine, polyamide, polyacetal, polyvinyl, polyureathane, epoxy, polysiloxane, polycarbosilane, polysilane, and polysulfone. The surface coating generally has a thickness of about 0.1 μm to 1 mm and any value or range therebetween.

In another non-limiting aspect of the present invention, the expandable material can optionally include a shape memory alloy-coated microballoon, a microlattice, reticulated foam, or syntactic shape memory alloy which is stabilized in an expanded state, pre-compressed, and then expanded to provide an actuating force under conditions suitable for well completion and/or development; however, this is not required. In one non-limiting embodiment, there is provided an expandable material which comprises a shape memory alloy-coated microballoon, a microlattice, reticulated foam, or syntactic shape memory alloy which is stabilized in an expanded state, pre-compressed, and then expanded to provide an actuating force under conditions suitable for well completion and development.

In another non-limiting aspect of the present invention, the expandable material can be in the form of a proppant used to open cracks and control permeability in underground formations; however, this is not required.

Thus, it is an object of the present invention to provide improved centralizers and methods of installing a centralizer downhole in a well through a self-actuating mechanism based on expanding, dissolving and/or degrading, and/or reacting engineered materials.

It is another and/or alternative object of the present invention to provide a centralizing device that can be placed/attached to the outside diameter of a well insertion structure, such as a tube or other structure, that is designed to be inserted into a wellbore, a cavity, a tube or the like.

It is another and/or alternative object of the present invention to provide a well insertion structure that includes one or more slats, wings, bows, leaves, ribbons, extensions, and/or ribs, which one or more slats, wings, bows, leaves, ribbons, extensions, and/or ribs function as radial extensions that are positioned on the outer surface of the body of the well insertion structure.

It is another and/or alternative object of the present invention to provide a well insertion structure that can be inserted into a wellbore, a cavity, a tube or the like without obstruction by or damage to the one or more slats, wings, bows, leaves, ribbons, extensions, and/or ribs on the well insertion structure.

It is another and/or alternative object of the present invention to provide a well insertion structure that when positioned in a desired location in a wellbore, a cavity, a tube or the like, the one or more slats, wings, bows, leaves, ribbons, extensions, and/or ribs can be caused to move to a partially or fully deployed position.

It is another and/or alternative object of the present invention to provide a well insertion structure that includes one or more expandable, degradable metals that can be used to cause one or more of the slats, wings, bows, leaves, ribbons, extensions, and/or ribs to partially or fully move to the fully deployed position.

It is another and/or alternative object of the present invention to provide a well insertion structure that includes one or more slats, wings, bows, leaves, ribbons, extensions, and/or ribs that, when in the partially or fully open or expanded position, result in the one or more slats, wings, bows, leaves, ribbons, extensions, and/or ribs engaging the inner wall of the wellbore, a cavity, a tube or the like.

Other objects, advantages, and novel features of the present invention will become apparent from the following detailed description of the invention when considered in conjunction with the accompanying drawings.

BRIEF DESCRIPTION OF THE DRAWINGS

Referring particularly to the drawings for the purposes of illustration only and not limitation.

DESCRIPTION OF THE INVENTION

Figure 1:
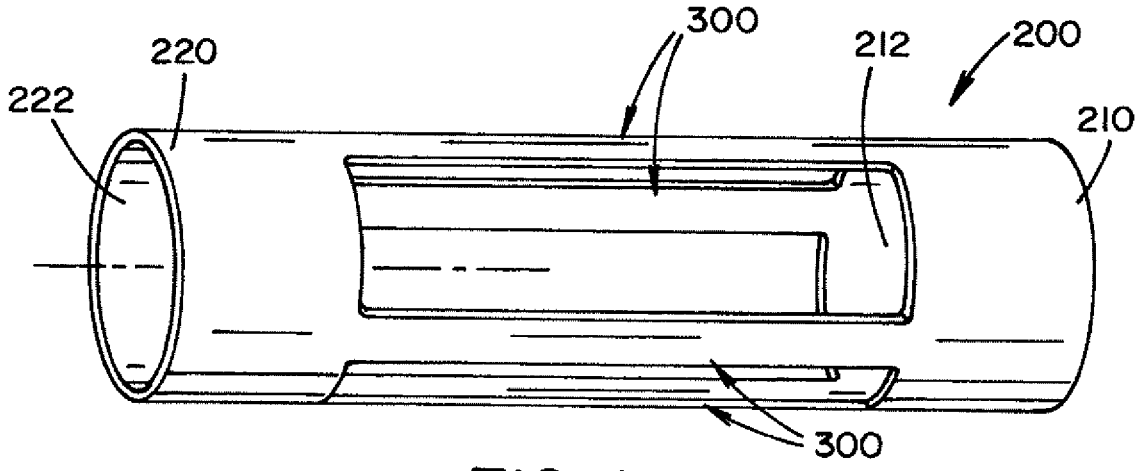
FIG. 1 is a side view of an annular centralizer with expanding bow elements in an unexpanded configuration.

The present invention relates to methods and constructions for centering components within a well, particularly an oil or gas well, more particularly to centralizers for use in drilling and completion operations, and still more particularly to centralizer devices which employ interventionless mechanisms to deploy and retract a tube, liner, casing, etc. in a drilling or well operation.

The present invention uses materials that have been developed to react and/or respond to wellbore conditions. These materials can be used to create various responses in a wellbore, such as dissolution, structural degradation, shape change, expansion, change in viscosity, reaction (heating or even explosion), changed magnetic or electrical properties, and/or others of such materials. These responses can be triggered by a change in temperature from the surface to a particular location in the wellbore, change in pH about the material, controlling salinity about the region of the material, addition or presence of a chemical (e.g., $CO_2$, etc.) to react with the material, and/or electrical stimulation (e.g., introducing an electrical current, current pulse, etc.) to the material, among others. These materials can be used in conjunction with a centralizer to activate and/or deactivate the centralizer.

When structural expandable materials are used with a centralizer, these expandable structural materials can be used to apply forces to the bow structure of a centralizer, thereby causing such bow structures to deploy once the centralizer is placed in a desired position in the wellbore. Similarly, when a degradable structural material is used with the centralizer, such as, but not limited to, a ring, sleeve, spring, bolt, rivet, bracket, pin, clip, etc., such degradable structural material can be used to retain, compress and/or constrain a centralizer utilizing spring-loaded wings or bows. In such a configuration, when the degradable structural material is caused to dissolve and/or degrade (thereby removing or weakening the degradable structural material) the spring-loaded wings or bows will be allowed to actuate and deploy of on the centralizing device. By combining degradable materials on a centralizing device, a novel centralizing device can be created that can be automatically deployed and/or retracted in a controlled manner in a wellbore. As can also be appreciated, after the centralizing device has been deployed, the centralizing device can be caused to be disabled by the degradable structural material. For example, a degradable structural material can be in the form of a retaining pin that can be designed to dissolve and/or degrade to thereby cause the pin to fail, which pin failure causes the spring force on the wings or bows to be reduced or lost. As can be appreciated, many other or additional components of the centralizing device can be formed of a degradable structural material to cause the centralizing device to be activated or deactivated. As can be appreciated, one type of degradable structural material can be used to cause the activation of the centralizing device, and a different degradable structural material can be used to disable or deactivate the centralizing device; however, this is not required.

Figure 2:
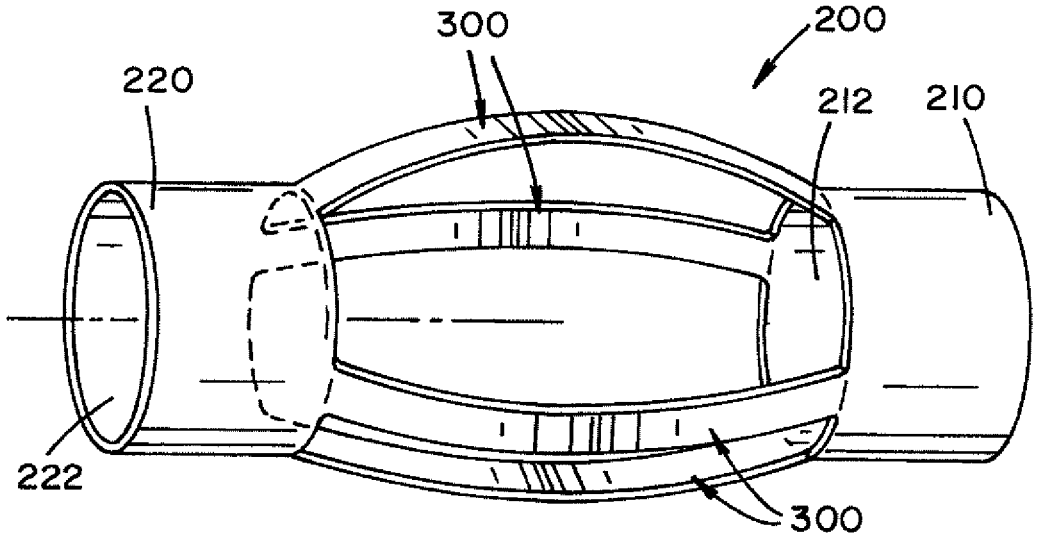
FIG. 2 is a side view of an annular centralizer with expanding bow elements in an expanded configuration.

Referring now to FIG. 1, there is illustrated a centralizer 200 in a non-deployed position or unexpanded position. The centralizer includes first and second end portions 210, 220 that are connected together by a plurality of bendable ribs 300. As defined herein, the bendable ribs are one type of well bore wall engagement member that can be included on the centralizer. The end portions each have a cylinder shape having a cavity 212, 222 that is configured to fit about a pipe. The ribs having a generally rectangular shape and are spaced from one another. FIG. 2 illustrates the centralizer in the deployed or expanded position. The ribs in the centralizer can be caused to controllably deploy using an expandable material. As can be appreciated, the centralizer can have other configurations wherein a portion of the centralizer moves from a non-deployed to a deployed position. As illustrated in FIGS. 1 and 2, the maximum outer perimeter of the centralizer in FIG. 2 is greater in size to the maximum outer perimeter of the centralizer in FIG. 1. The increase in the size of the outer perimeter of the centralizer in FIG. 2 is the result of the outward bowing of the ribs 300. The amount of bowing of the ribs caused by the expandable material is non-limiting. In one non-limiting embodiment, the increase in the size of the outer perimeter of the centralizer is a result of the one or more well bore wall engagement members on the centralizer (e.g., slat, wing, bow, leave, ribbon, extension, rib, etc.) moving from the non-deployed position to the deployed position is at least about 0.1 inches, typically at least about 0.25 inches, and more typically at least about 0.75 inches. In one specific non-limiting aspect of the invention, the increase in the size of the outer perimeter of the centralizer as a result of the one or more well bore wall engagement members on the centralizer moving from the non-deployed position to the deployed position is about 0.1-20 inches (and all values and ranges therebetween), and typically 0.25-10 inches. In another specific non-limiting aspect of the invention, the percent increase in the size of the outer perimeter of the centralizer as a result of the one or more well bore wall engagement members on the centralizer moving from the non-deployed position to the deployed position is about 2-300% (and all values and ranges therebetween), and typically 5-100%. As can be appreciated, the amount of bowing of the ribs caused by the expandable material can be controlled by various factors (e.g., amount of expandable material used, the thickness of the bendable material used to form the ribs, the type of material used to form the bendable material used to form the ribs, the type of material used to form the expandable material, the degree to which the expandable material is caused to expand, the configuration of the ribs, the use of slots or other structures in the bendable material used to form the ribs, etc.).

Figure 3:
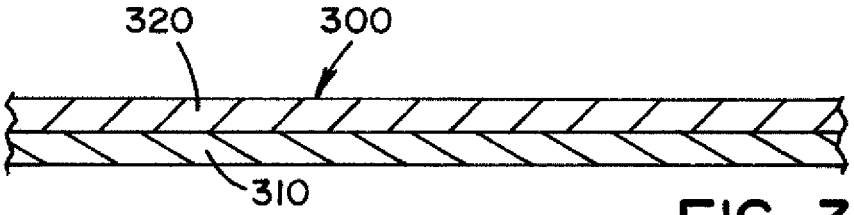
FIG. 3 is a side cut-away view of one bow element that is formed of a structural material and an expandable structural material wherein the expanded material has not been caused to be expanded.
Figure 4:
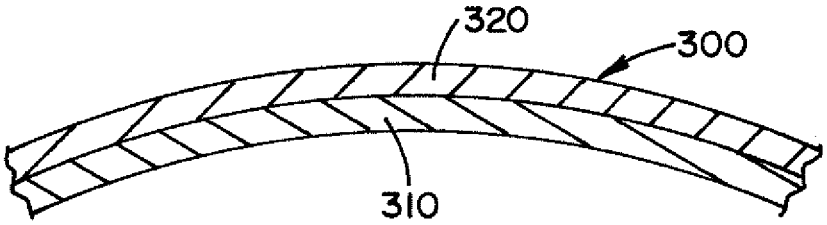
FIG. 4 is a side cut-away view of the bow element of FIG. 3 wherein the expanded material has been caused to be expanded to thereby cause the bow element to bow.

Referring now to FIGS. 3 and 4, there is illustrated a cross-section of one non-limiting configuration of rib 300. As illustrated in FIGS. 3 and 4, the rib is formed of a bendable material 310 such as a metal and includes a layer of expandable material 320. The expandable material can be a) mechanically connected to the bendable material (e.g., friction fit, screw, rivet, bolt, etc.), b) connected by an adhesive, c) connected by welding to the bendable material, d) connected by lamination to the bendable material and/or e) cast to the bendable material. When the expandable material is caused to expand, the expandable material applies a force to the bendable material and causes the bendable material to bend or bow as illustrated in FIG. 4. The bending of the ribs of the centralizer results in the centralizing moving to the deployed position and centralizing a pipe in a well bore.

Figure 5:
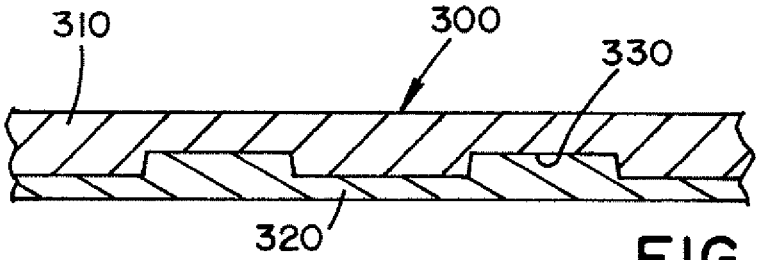
FIG. 5 is a side cut-away view of another bow element that is formed of a structural material and an expandable structural material wherein the expanded material has not been caused to be expanded.
Figure 6:
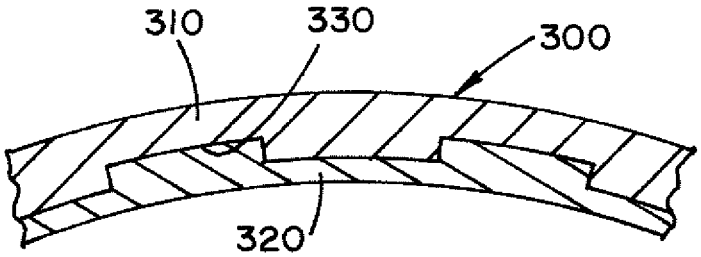
FIG. 6 is a side cut-away view of the bow element of FIG. 5 wherein the expanded material has been caused to be expanded to thereby cause the bow element to bow.

Referring now to FIGS. 5 and 6, cross section of another non-limiting rib 300 is illustrated. The rib is formed of a bendable material 310 (such as a metal) and includes a layer of expandable material 320. The bendable material includes one or more notches or depressions 330 that are filled with the expandable material. The expandable material can be a) mechanically connected to the bendable material (e.g., friction fit, screw, rivet, bolt, etc.), b) connected by an adhesive, c) connected by welding to the bendable material, d) connected by lamination to the bendable material and/or e) cast to the bendable material. As illustrated by the arrows in FIGS. 5 and 6, when the expandable material is caused to expand, the expandable material applies a force to the bendable material and causes the bendable material to bend or bow as illustrated in FIG. 6. The bending of the ribs of the centralizer results in the centralizing move to the deployed position and centralizing a pipe in a well bore.

Figure 7:
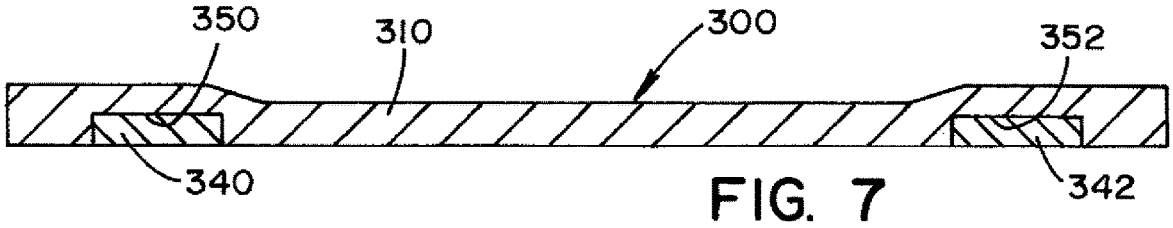
FIG. 7 is a side cut-away view of another bow element that is formed of a structural material and an expandable structural material wherein the expanded material has not been caused to be expanded.
Figure 8:
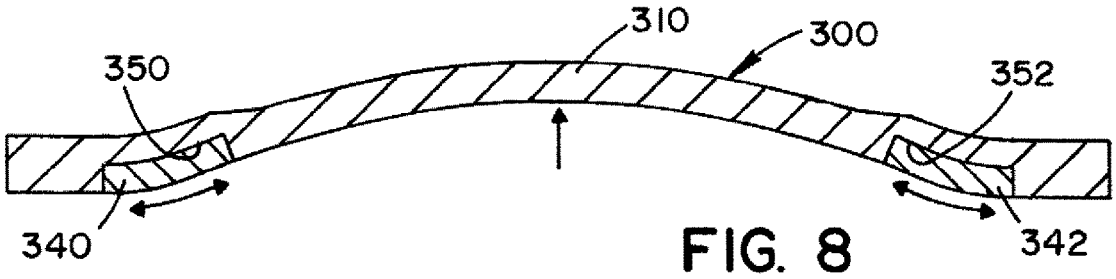
FIG. 8 is a side cut-away view of the bow element of FIG. 7 wherein the expanded material has been caused to be expanded to thereby cause the bow element to bow.

Referring now to FIGS. 7 and 8, cross section of another non-limiting rib 300 is illustrated. The rib is formed of a bendable material 310 (such as a metal) and includes two regions of expandable material 340, 342. The bendable material includes one or more notches or depressions 350, 352 located at each end portion of the rib. The one or more notches or depressions are filled with the expandable material. The expandable material can be a) mechanically connected to the bendable material (e.g., friction fit, screw, rivet, bolt, etc.), b) connected by an adhesive, c) connected by welding to the bendable material, d) connected by lamination to the bendable material and/or e) cast to the bendable material. As illustrated by the arrows in FIG. 8, when the expandable material is caused to expand, the expandable material applies a force to the bendable material and causes the bendable material to bend or bow. The bending of the ribs of the centralizer results in the centralizing move to the deployed position and centralizing a pipe in a well bore.

Figure 9:
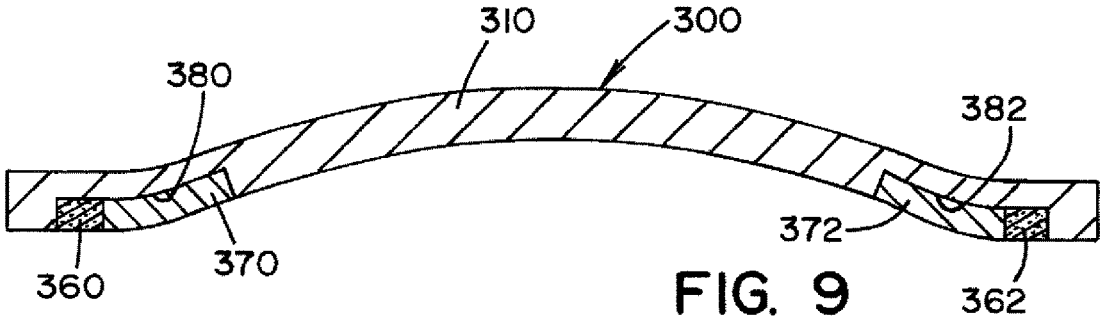
FIG. 9 is a side cut-away view of another bow element that is formed of a structural material and an expandable structural material and a degradable material wherein the expanded material has been caused to be expanded to thereby cause the bow element to bow and wherein the degradable material has not been caused to degrade.
Figure 10:
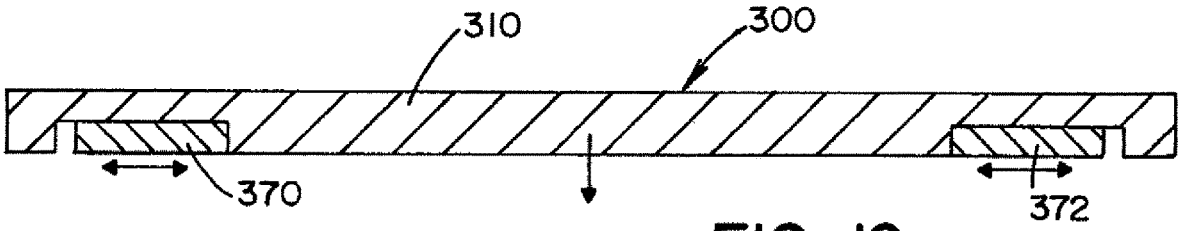
FIG. 10 is a side cut-away view of the bow element of FIG. 9 wherein the degradable material is caused to degrade after the expanded material has been caused to be expand to thereby cause the bow element to move back to the unbowed position.

Referring now to FIGS. 9 and 10, the rib 300 can optionally include a degradable metal 360, 362 that is located adjacent to expandable material 370, 372 that is located in notches or depressions 380, 382. After the rib has been caused to bend by the expansion of the expandable material as illustrated in FIG. 9, the rib can be allowed to flex or move partially or fully to the unbent position by reducing the bending force on the bendable material that is caused by the expansion of the expandable material. Such reduction in force as illustrated by the arrow in FIG. 10 can be accomplished by causing the degradable metal to dissolve and/or degrade as illustrated in FIG. 10. The partial or full removal of the degradable metal from the rib results in the bending force being applied by the expanded expandable material to be reduced or eliminated, thereby allowing the rib to unbend or bend partially or fully back to its position prior to the expansion of the expandable material. The ribs can be formed of a memory metal to facilitate in the movement of the rib back to the unbent position; however, this is not required. The expandable material and the degradable metal can be a) mechanically connected to the bendable material (e.g., friction fit, screw, rivet, bolt, etc.), b) connected by an adhesive, c) connected by welding to the bendable material, d) connected by lamination to the bendable material and/or e) cast to the bendable material.

The non-limiting embodiments illustrated in FIGS. 3-10 merely illustrate a few of the many configurations that can be used to cause the well bore wall engagement members on the centralizer (e.g., slat, wing, bow, leave, ribbon, extension, rib, etc.) to bend and optionally unbend.

Figure 11:
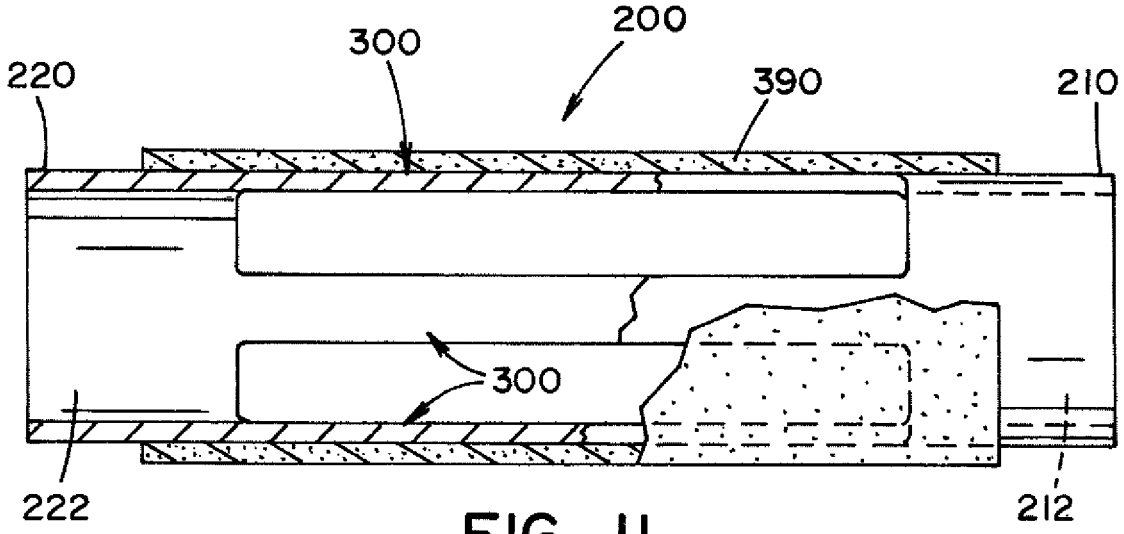
FIG. 11 is a side view of an annular centralizer with expanding bow elements in an unexpanded configuration wherein the bows are retained in an unbowed position by a degradable sleeve.
Figure 12:
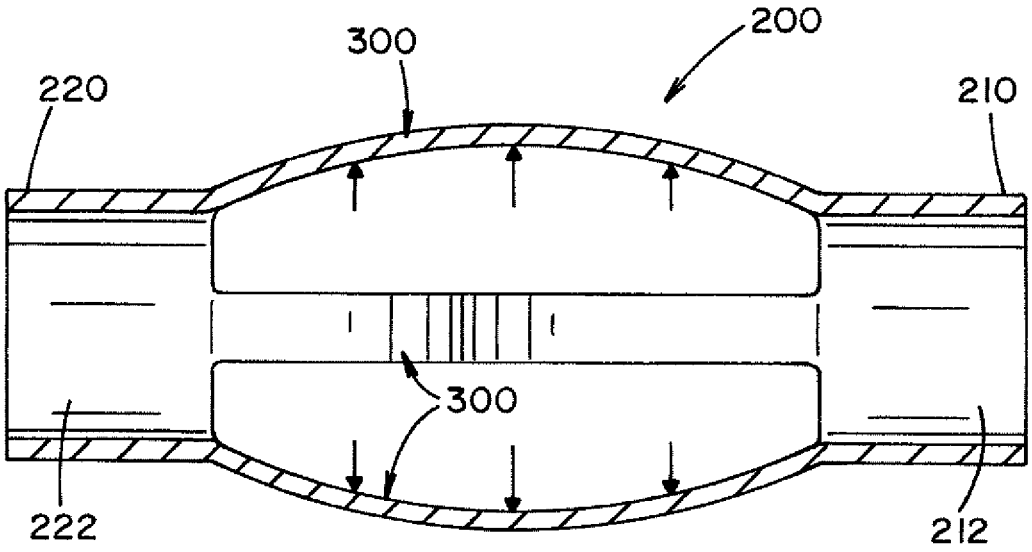
FIG. 12 is a side view of the annular centralizer of FIG. 11 in the expanded position wherein the degradable sleeve is dissolved and/or degraded to allow the bow elements to move to the bow position.

Referring now to FIGS. 11 and 12, there is illustrated another type of centralizer 200. The ribs 300 of the centralizer are configured to move to a bent state when no constraining force is applied to the ribs. The ribs are maintained in an unbent state by use of a retaining member 390. As such, the ribs are biased in a bent state, but are retained in the unbent state by the retaining member. As can be appreciated, the ribs may not be biased in a bent state, but can be activated (e.g., temperature change, pH change, chemistry change, electric stimulation, etc.) to move to the bent state by some activation stimulus after the retaining member has been partially or fully dissolved and/or degraded. As can be appreciated, such activation can occur prior to, during, or after the retaining member has been partially or fully dissolved and/or degraded. As also can also or alternatively be appreciated, the ribs can be caused to be moved to the bent state by use of an expandable material as illustrated in FIGS. 3-9; however, this is not required. As illustrated in FIG. 6*a*, the retaining member 400 partially or fully encircles all or a portion of the ribs. As can be appreciated, other retaining member configurations can be used to maintain the ribs in an unbent position. The retaining member is made of a degradable metal. When the degradable metal partially or fully dissolves and/or degrades, the retaining force of the ribs is reduced or eliminated, thereby enabling the ribs to move from the non-deployed to the deployed position.

Generally, the expandable material is typically configured to expand less than 5 vol. % in the well bore prior to being activated, typically expand less than 2 vol. % in the well bore prior to being activated, more typically expand less than 1 vol. % in the well bore prior to being activated, and still more typically expand less than 0.5 vol. % in the well bore prior to being activated. Likewise, the degradable material is typically configured to degrade less than 5 vol. % in the well bore prior to being activated, typically degrade less than 2 vol. % in the well bore prior to being activated, more typically degrade less than 1 vol. % in the well bore prior to being activated, and still more typically degrade less than 0.5 vol. % in the well bore prior to being activated. The activation of the expandable or the degradable material can be accomplished by one or more events selected from the group consisting of a) change in temperature about the expandable material or the degradable material from the surface of the well bore to a particular location in the well bore, b) change in pH about the expandable material or the degradable material, c) change in salinity about the expandable material or the degradable material, d) exposure of the expandable material or the degradable material to an activation element or compound, e) electrical stimulation of the expandable material or the degradable material, f) exposure of the expandable material or the degradable material to a certain sound frequency, and/or g) exposure of the expandable material or the degradable material to a certain electromagnetic frequency.

Expandable Materials that can be Used in a Centralizer

Non-limiting examples of expandable materials that can be used in a centralizer are set forth below:

Example 1

A high temperature resistant and tough thermoplastic polysulfone with 25% volumetric loading of expanding Fe micro powder showed an unconstrained volumetric expansion of 50% is possible in a solution of 2% KCl at 190° C. over a period of 50 hours.

Example 2

A 30% volumetric loading of expandable metal CaO powder in epoxy binder milled and sieved to 8/16 mesh size showed a 24% volumetric expansion while under 3,000 psig fracture load stress when exposed to a solution of 2% KCl, 0.5M $NaCO_3$ at 60-80° C. in a period of 1 hour.

Example 3

A 30% volumetric loading of expandable metal CaO powder in 6,6 nylon binder under 2,500 psig fracture load stress when exposed to a solution of 2% KCl, 0.5M $NaCO_3$ at 60-80° C. in a period of 1 hour.

The high force reactive expandables that are used in the centralizer are engineered to act as a force delivery system to cause the centralizer to move to a partially or fully deployed position. The deployment of the high force reactive expandables can be at least partially controlled. Such control can be accomplished by coating, encapsulating, microstructure placement and alignment and/or otherwise shielding the expandable core particle with a dissolving/triggerable surface coating that will dissolve and/or degrade under specific formation conditions. The volumetric expansion of the expandable core particle in such an aspect of the invention can then be constrained to deliver force.

Figure 13:
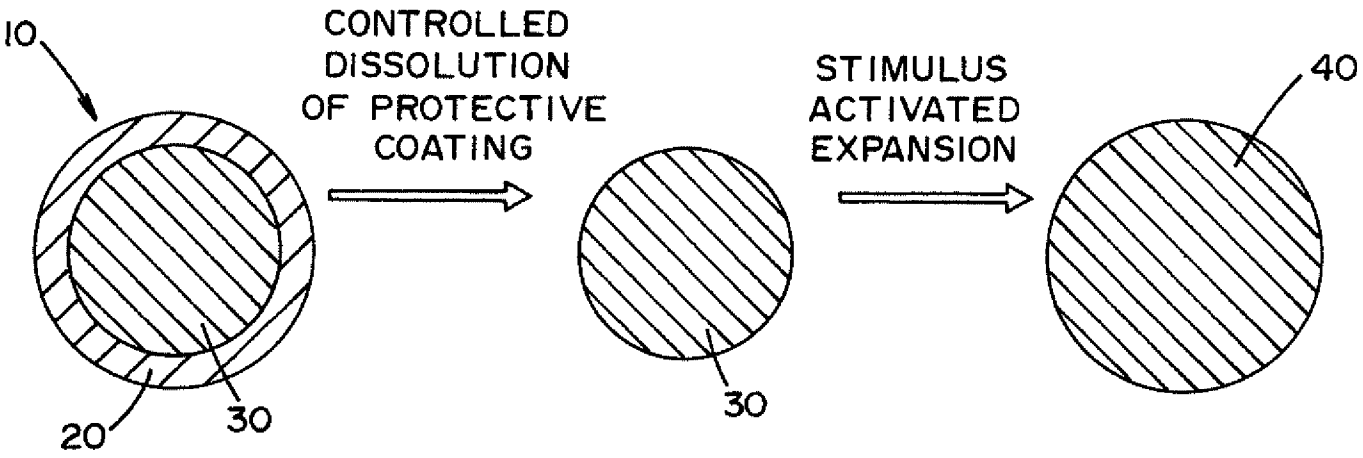
FIG. 13 is an illustration of core particles reacting under controlled stimulus, at which point the core particle will expand, expanding the fracture to enhance oil and gas recovery.

FIGS. 13 and 14 illustrate non-limiting methods for controlling the volumetric expansion of the expandable core particle. The core particles can be designed to react under controlled stimulus, at which point the core will expand. One non-limiting feature of the invention is the controlling of the timing/trigger, and/or amount and/or speed of the expanding reaction. Control/trigger coatings can also be used (e.g., temperature activated coatings, chemically activated engineered response coatings, etc.). Control of the protective layer thickness and/or composition can be used to dictate where and under what conditions the reactive composite core particle will be exposed to formation fluids. Once exposed, the expandable materials will expand volumetrically and, with properly engineered constraint, direct the volumetric expansion as a normal force to cause the centralizer to move to a partially or fully deployed position.

Referring to FIG. 13, there is illustrated an expandable material 10 that includes a protective layer or surface coating 20, an expandable core 30 which can include, but is not limited to, an expanding metal, structural filler, and activator in a diluent/binder to control mechanical properties. The protective layer is generally formulated to dissolve and/or degrade when exposed to a controlled external stimulus (e.g., temperature and/or pH, chemicals, etc.). The protective layer is used to control activation of the expanding of the expandable core 30, which upon expansion becomes expanded core 40. Protective layer 20 can be comprised of one or more of, but not limited to, polyester, polyether, polyamine, polyamide, polyacetal, polyvinyl, polyureathane, epoxy, polysiloxane, polycarbosilane, polysilane, and polysulfone. Protective layer 20 can range in thickness from, but not limited to, 0.1-1 mm and any value or range therebetween, and generally range from 10 μm to 100 μm and any value or range therebetween. Composition of the expandable core 30 can include an expanding material that can be, but is not limited to, Ca, Li, CaO, $Li_2O$, $Na_2O$, Fe, Al, Si, Mg, $K_2O$ and Zn. The expandable material can range in volumetric percentage of expandable core 30 of, but not limited to, 5-60% and any value or range therebetween, and generally range from 20-40% and any value or range therebetween. Composition of the expandable core 30 may or may not include a structural filler that can be, but is not limited to, fumed silica, silica, glass fibers, carbon fibers, carbon nanotubes and other finely divided inorganic material. Structural filler can range in volumetric percentage of expandable core 30 of, but not limited to, 1-30% and any value or range therebetween, and generally range from 5-20% and any value or range therebetween. Composition of expandable core 30 may or may not include an activator that can be, but is not limited to, peroxide, metal chloride, or galvanically-active material. Composition of expandable core 30 can include a diluent/binder that can be, but is not limited to, polyacetals, polysulfones, polyurea, epoxys, silanes, carbosilanes, silicone, polyarylate, and polyimide. Binder can range in volumetric percentage of expandable core 30 of, but not limited to, 50-90% and any value or range therebetween, and generally range from 50-70% and any value or range therebetween. Expandable core 30 expands into expanded core 40 in the range of 5-50% volumetric expansion and any value or range therebetween, and generally in the range of 5-20% and any value or range therebetween.

Figure 14A:
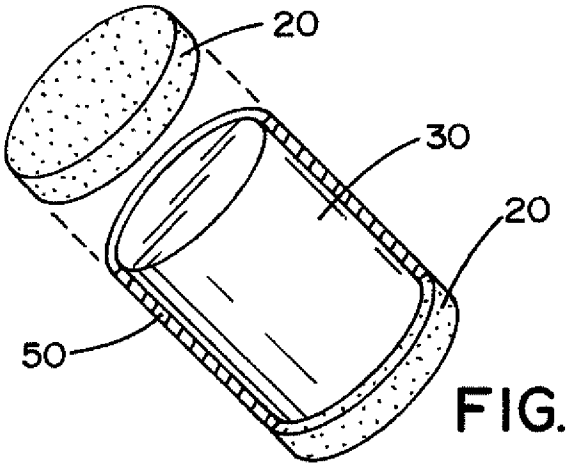
FIGS. 14*a* and 14*b* illustrate a non-limiting method of engineering a force delivery system for expanding into fracture opening, namely constraint by a semi-permeable or impermeable matrix.
Figure 14B:
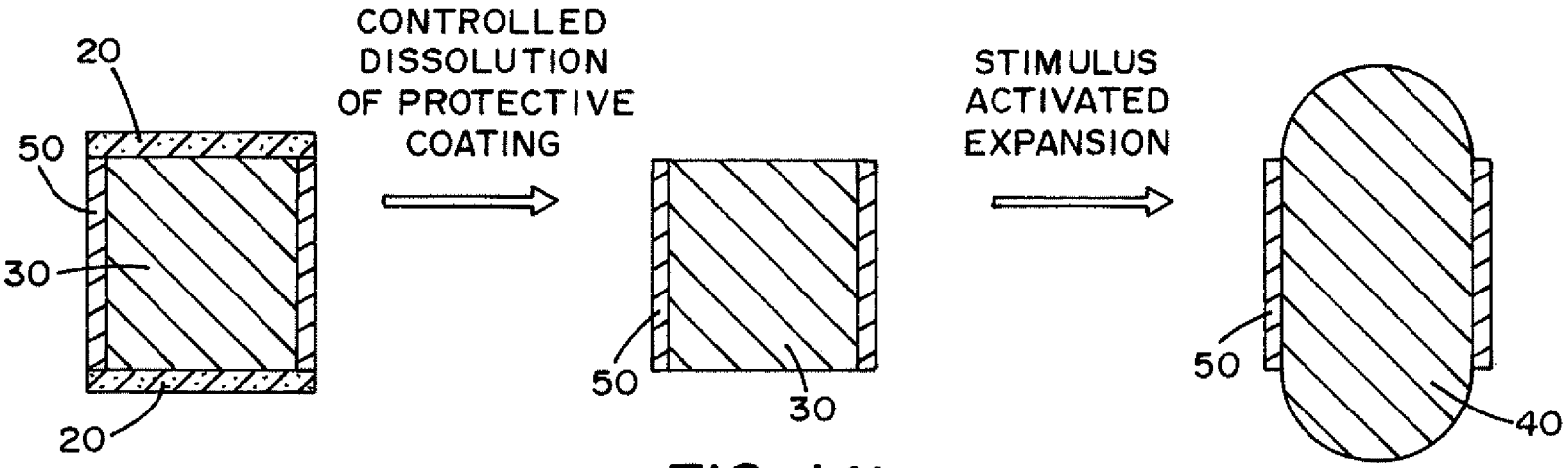

Referring now to FIGS. 14*a* and 14*b*, a non-limiting method of engineering force delivery system to cause the centralizer to move to a partially or fully deployed position is illustrated, namely constraint by a semi-permeable or impermeable sleeve (FIG. 14*a*). Constraining sleeve translates triggered expansion into a uniaxial force (FIG. 14*b*). The protective layer 20 (in the form of a plug) is formulated to dissolve and/or degrade or become permeable when exposed to controlled external stimulus (temperature, pH, certain chemicals, etc.) to cause the protective layer to dissolve and/or degrade or otherwise breakdown, thereby controlling activation of expanding of the expandable core 30. Upon expansion to expanded core 40 constraining sleeve 50 directs expansion forces parallel to constraining sleeve.

The protective layer 20 (when used) can be comprised of one or more of, but not limited to, polyester, polyether, polyamine, polyamide, polyacetal, polyvinyl, polyureathane, epoxy, polysiloxane, polycarbosilane, polysilane, and polysulfone. Protective layer 20 can range in thickness from, but is not limited to, 0.1-1 mm, and generally range from 10-100 μm. Composition of expandable core 30 can include an expanding material that can be, but is not limited to, Ca, Li, CaO, $Li_2O$, $Na_2O$, Fe, Al, Si, Mg, $K_2O$ and Zn. The expandable material can range in volumetric percentage of expandable core 30 of, but is not limited to, 5-60%, and generally range from 20-40%. The composition of expandable core 30 may or may not include a structural filler that can be, but is not limited to, fumed silica, silica, glass fibers, carbon fibers, carbon nanotubes and other finely divided inorganic material. The structural filler can range in volumetric percentage of expandable core 30 of, but is not limited to, 1-30%, and generally range from 5-20%. The composition of expandable core 30 may or may not include an activator that can be, but is not limited to, peroxide, metal chloride, or galvanically active material. The composition of expandable core 30 can include a diluent/binder that can be, but is not limited to, polyacetals, polysulfones, polyurea, epoxies, silanes, carbosilanes, silicone, polyarylate, and polyimide. The binder can range in volumetric percentage of expandable core 30 of, but is not limited to, 50-90%, and generally range from 50-70%. Expandable core 30 is configured to expand into expanded core 40 in the range of 5-50% volumetric expansion, and generally in the range of 5-20%. The constraining sleeve 50 can include, but is not limited to, one or more high temperature-high strength materials such as polycarbonate, polysulfones, epoxies, polyimides, inert metals (e.g., Cu with leachable salts), etc. Constraining layer 50 can range in thickness from, but not limited to 0.1 μm to 1 mm, and generally range from 10-100 μm. The configuration of the constraining sleeve 50 is non-limiting, as other shape configurations are applicable for imparting directional expansion. Generally, the constraining sleeve is designed to not rupture during the expansion of expandable core 30; however, this is not required. In one non-limiting arrangement, the constraining sleeve is designed to not rupture and may or may not deform during the expansion of expandable core 30. The constraining sleeve can include one or more side openings; however, this is not required. The one or more side opening can be used as an alternative or in addition to the one or more end openings in the constraining sleeve. The one or more side openings (when used) can optionally include a protective coating that partially or fully covers the side opening.

Figure 15A:
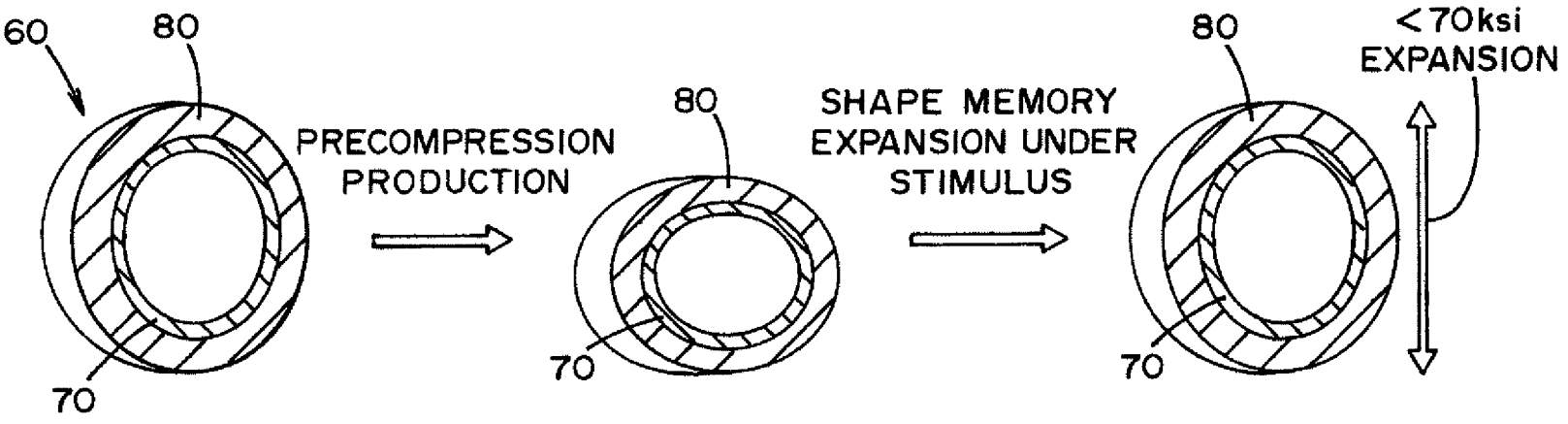
FIGS. 15*a* and 15*b* are schematics of shape memory alloy syntactic, as well as actual syntactic metal.
Figure 15B:
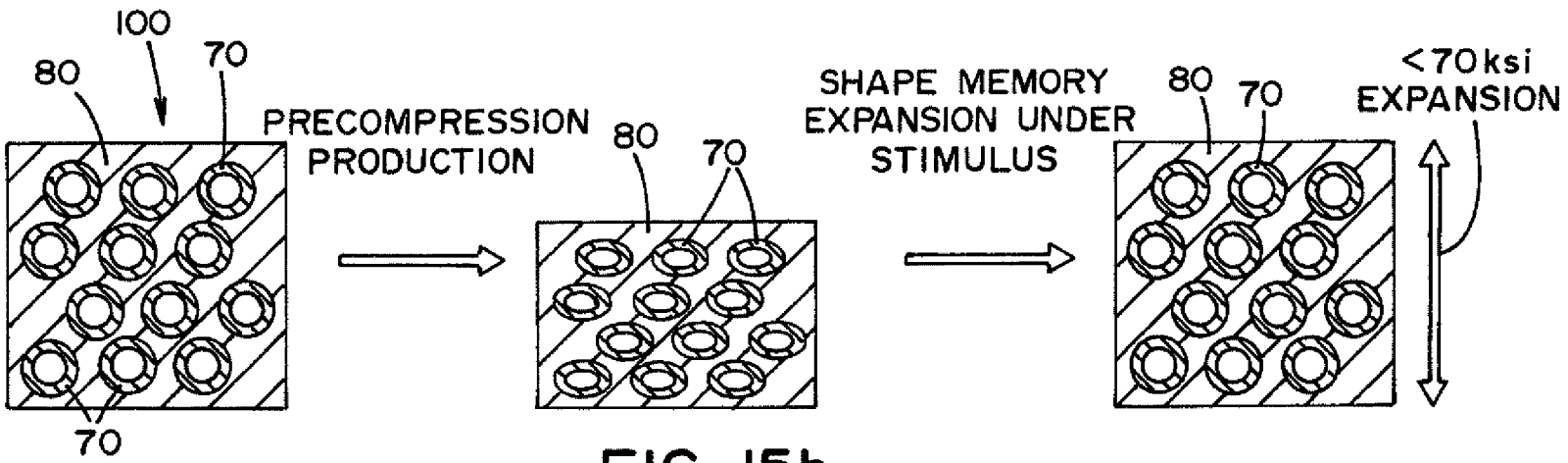

FIGS. 15*a* and 15*b* illustrate the construction of shape memory expandables derived from metal- or plastic-coated hollow sphere 60 or syntactic 100. Shape memory expandables can include, but are not limited to, a hollow sphere core 70 and a plastic or metal coating or composite 80. The shape memory composites 60 and 100 are compressed under temperature promoting plastic yield and then cooled while compressed, locking in potential mechanical force to produce shape memory expandables. Under the external stimulus of temperature above glass transition temperatures, the shape memory composites return to their uncompressed states exerting up to 30-70 Ksi forces and any value or range therebetween. Hollow sphere core 70 can be comprised of, but is not limited to, glass (borosilicate, aluminosilicate, etc.), metal (magnesium, zinc, etc.), or plastic (phenolic, nylon, etc.), which range in sizes from 10 nm to 5 mm and any value or range therebetween, and generally range from 10-100 μm. Coating or composite matrix 80 can be comprised of one or more of, but not limited to, metal (titanium, aluminum, magnesium, etc.), or plastic (epoxy, polysulfone, polyimides, polycarbonate, polyether, polyester, polyamine, polyvinyl, etc.), which range in composite volume percentages from 1-70% and any value or range therebetween. Actual compressed and non-compressed syntactics are illustrated and, in this case, the compression is reversed using the shape memory effects delivering forces as high as 30-70 Ksi. Advantages of the shape memory alloy include low density, very high actuation force, and/or very controllable actuation.

Expandable Chemistries

In still another non-limiting aspect of the invention, a feature in the expandable design of the high force reactive expandables is the active expandable material. Active expandable material having reactive mechanical or chemical changes occurring in the temperature range of at least 25° C. (e.g., 30-350° C., 30-250° C., etc. and all values and ranges therebetween) and having a volumetric expansion of over 10% (e.g., 20-400%, 30-250%, etc. and all values and ranges therebetween) can be utilized in the present invention. Table 1 lists some non-limiting specific reactions that are suitable for use in the structural expandable materials and for the expandable proppants:

Table 1

CaO→CaCO3 119% expansion
Fe→Fe2O3 115% expansion
Si→SiO2 88% expansion
Zn→ZnO 60% expansion
Al→Al2O3 29% expansion The formation of hydroxides and/or carbonates can potentially result in larger expansion percentages.

In still another non-limiting aspect of the invention, there is provided a method to control the rate and/or completion of the oxidation reaction through 1) control over active particle surface area, 2) binder/polymer permeability control, 3) the addition of catalysis (e.g., $AlCl_3$—used to activate iron surfaces), and/or 4) control over water permeability/transport to the metal surface. Ultrafine and near nanomaterials, as well as metallic flakes (which expand primarily in one direction) can be used to tailor the performance and response of these expandable materials. Mechanical properties such as modulus, creep strength, and/or fracture strength can also or alternatively be controlled through the addition of fillers and diluents (e.g., oxides, etc.) and semi-permeable engineering polymers having controlled moisture solubility.

Degradable Materials that can be Used in a Centralizer

Non-limiting examples of degradable materials that can be used in a centralizer are set forth below.

Example 1

An AZ91D magnesium alloy having 9 wt. % aluminum, 1 wt. % zinc and 90 wt. % magnesium was melted to above 800° C. and at least 200° C. below the melting point of nickel. About 7 wt. % of nickel was added to the melt and dispersed. The melt was cast into a steel mold. The degradable metal exhibited a tensile strength of about 14 Ksi, an elongation of about 3%, and shear strength of 11 Ksi. The degradable metal dissolved and/or degraded at a rate of about 75 mg/cm$^2$-min in a 3% KCl solution at 90° C. The material dissolved and/or degraded at a rate of 1 mg/cm$^2$-hr in a 3% KCl solution at 21° C. The material dissolved and/or degraded at a rate of 325 mg/cm$^2$-hr. in a 3% KCl solution at 90° C.

Example 2

An AZ91D magnesium alloy having 9 wt. % aluminum, 1 wt. % zinc and 90 wt. % magnesium was melted to above 800° C. and at least 200° C. below the melting point of copper. About 10 wt. % of copper alloyed to the melt and dispersed. The melt was cast into a steel mold. The degradable metal exhibited a tensile yield strength of about 14 Ksi, an elongation of about 3%, and shear strength of 11 Ksi. The degradable metal dissolved and/or degraded at a rate of about 50 mg/cm$^2$-hr. in a 3% KCl solution at 90° C. The material dissolved and/or degraded at a rate of 0.6 mg/cm$^2$-hr. in a 3% KCl solution at 21° C.

Example 3

An AZ91D magnesium alloy having 9 wt. % aluminum, 1 wt. % zinc and 90 wt. % magnesium was melted to above 700° C. About 16 wt. % of 75 um iron particles were added to the melt and dispersed. The melt was cast into a steel mold. The degradable metal exhibited a tensile strength of about 26 Ksi, and an elongation of about 3%. The degradable metal dissolved and/or degraded at a rate of about 2.5 mg/cm$^2$-min in a 3% KCl solution at 20° C. The material dissolved and/or degraded at a rate of 60 mg/cm$^2$-hr in a 3% KCl solution at 65° C. The material dissolved and/or degraded at a rate of 325 mg/cm$^2$-hr. in a 3% KCl solution at 90° C.

Example 4

An AZ91D magnesium alloy having 9 wt. % aluminum, 1 wt. % zinc and 90 wt. % magnesium was melted to above 700° C. About 2 wt. % 75 um iron particles were added to the melt and dispersed. The melt was cast into steel molds. The material exhibited a tensile strength of 26 Ksi, and an elongation of 4%. The material dissolved and/or degraded at a rate of 0.2 mg/cm$^2$-min in a 3% KCl solution at 20° C. The material dissolved and/or degraded at a rate of 1 mg/cm$^2$-hr in a 3% KCl solution at 65° C. The material dissolved and/or degraded at a rate of 10 mg/cm$^2$-hr in a 3% KCl solution at 90° C.

Example 5

An AZ91D magnesium alloy having 9 wt. % aluminum, 1 wt. % zinc and 90 wt. % magnesium was melted to above 700° C. About 2 wt. % nano iron particles and about 2 wt. % nano graphite particles were added to the composite using ultrasonic mixing. The melt was cast into steel molds. The material dissolved and/or degraded at a rate of 2 mg/cm2-min in a 3% KCl solution at 20° C. The material dissolved and/or degraded at a rate of 20 mg/cm2-hr in a 3% KCl solution at 65° C. The material dissolved and/or degraded at a rate of 100 mg/cm2-hr in a 3% KCl solution at 90° C.

Example 6

A magnesium alloy that includes 9 wt. % aluminum, 0.7 wt. % zinc, 0.3 wt. % nickel, 0.2 wt. % manganese, and 2 wt.

% calcium was added to the molten magnesium alloy. The magnesium alloy dissolved and/or degraded at a rate of 91 mg/cm$^2$-hr. in the 3% KCl solution at 90° C. The magnesium alloy also dissolved and/or degraded at a rate of 34 mg/cm$^2$-hr. in the 0.1% KCl solution at 90° C., a rate of 26 mg/cm$^2$-hr. in the 0.1% KCl solution at 75° C., a rate of 14 mg/cm$^2$-hr. in the 0.1% KCl solution at 60° C., and a rate of 5 mg/cm$^2$-hr. in the 0.1% KCl solution at 45° C.

Example 7

1.5-2 wt. % zinc, 1.5-2 wt. % nickel, 3-6 wt. % gadolinium, 3-6 wt. % yttrium, and 0.5-0.8% zirconium were added to the molten magnesium. The dissolution rate in 3% KCl brine solution at 90° C. as 62-80 mg/cm$^2$-hr.

Example 8

An AZ91D magnesium alloy having 9 wt. % aluminum, 1 wt. % zinc and 90 wt. % magnesium. About 16 wt. % of 75 um iron particles were added to the melt and dispersed. The melt was cast into a steel mold. The iron particles did not fully melt during the mixing and casting processes. The degradable metal dissolved and/or degraded at a rate of about 2.5 mg/cm$^2$-min in a 3% KCl solution at 20° C. The material dissolved and/or degraded at a rate of 60 mg/cm$^2$-hr in a 3% KCl solution at 65° C. The material dissolved and/or degraded at a rate of 325 mg/cm$^2$-hr. in a 3% KCl solution at 90° C. The dissolving and/or degrading rate of the degradable metal for each these test was generally constant. The iron particles were less than 1 μm, but were not nanoparticles. However, the iron particles could be nanoparticles, and such addition would change the dissolving and/or degrading rate of the degradable metal.

Example 9

An AZ91D magnesium alloy having 9 wt. % aluminum, 1 wt. % zinc and 90 wt. % magnesium was melted to above 700° C. About 2 wt. % 75 um iron particles were added to the melt and dispersed. The iron particles did not fully melt during the mixing and casting processes. The material dissolved and/or degraded at a rate of 0.2 mg/cm$^2$-min in a 3% KCl solution at 20° C. The material dissolved and/or degraded at a rate of 1 mg/cm$^2$-hr in a 3% KCl solution at 65° C. The material dissolved and/or degraded at a rate of 10 mg/cm$^2$-hr in a 3% KCl solution at 90° C. The dissolving and/or degrading rate of the degradable metal for each these test was generally constant. The iron particles were less than 1 μm, but were not nanoparticles. However, the iron particles could be nanoparticles, and such addition would change the dissolving and/or degrading rate of the degradable metal.

Example 10

An AZ91D magnesium alloy having 9 wt. % aluminum, 1 wt. % zinc and 90 wt. % magnesium was melted to above 700° C. About 2 wt. % nano iron particles and about 2 wt. % nano graphite particles were added to the composite using ultrasonic mixing. The melt was cast into steel molds. The iron particles and graphite particles did not fully melt during the mixing and casting processes. The material dissolved and/or degraded at a rate of 2 mg/cm$^2$-min in a 3% KCl solution at 20° C. The material dissolved and/or degraded at a rate of 20 mg/cm$^2$-hr in a 3% KCl solution at 65° C. The material dissolved and/or degraded at a rate of 100 mg/cm$^2$-hr in a 3% KCl solution at 90° C. The dissolving and/or degrading rate of the degradable metal for each these test was generally constant.

Figure 19:
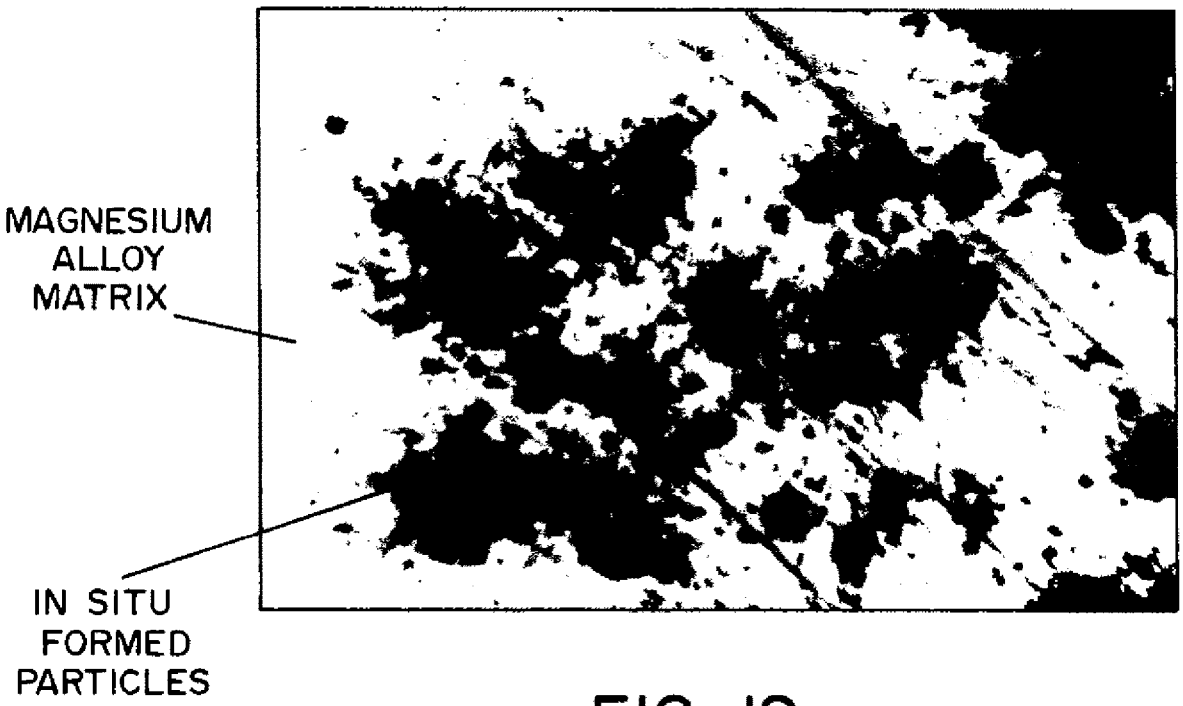
FIGS. 19-21 show a typical cast microstructure with galvanically-active in situ formed intermetallic phase wetted to the magnesium matrix; and, FIG. 22 shows a typical phase diagram to create in situ formed particles of an intermetallic $Mg_x(M)$ where M is any element on the periodic table or any compound in a magnesium matrix and wherein M has a melting point that is greater than the melting point of Mg.
Figure 20:
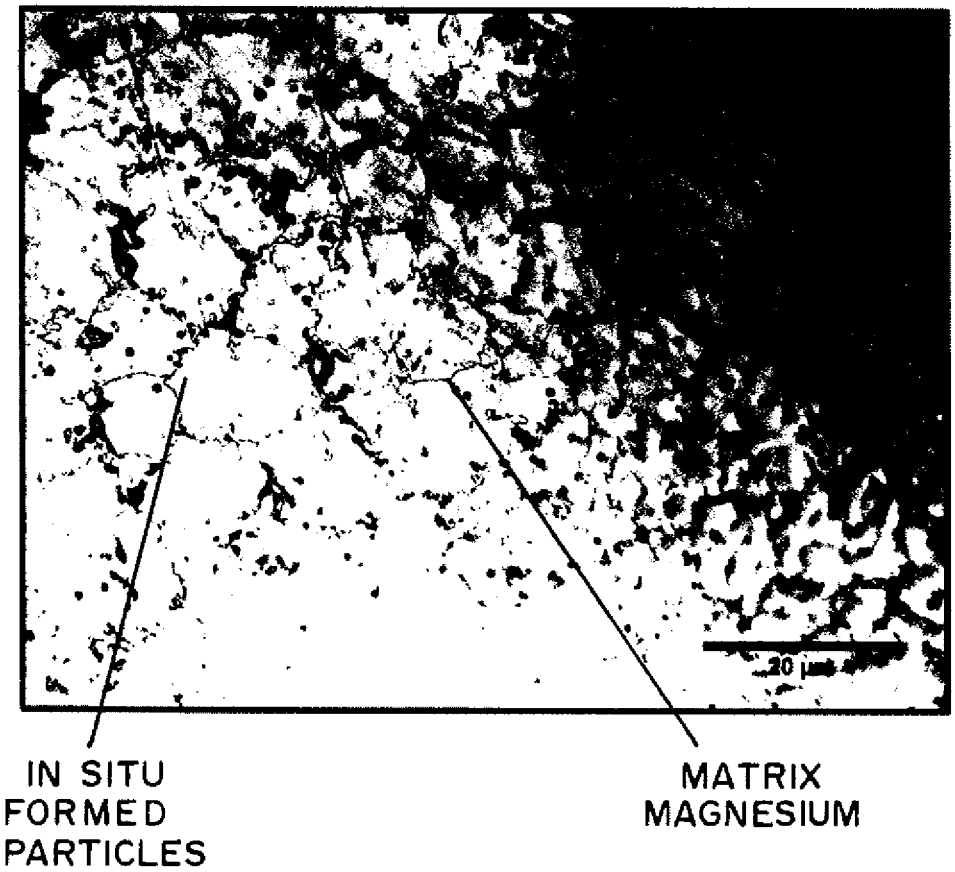
Figure 21:
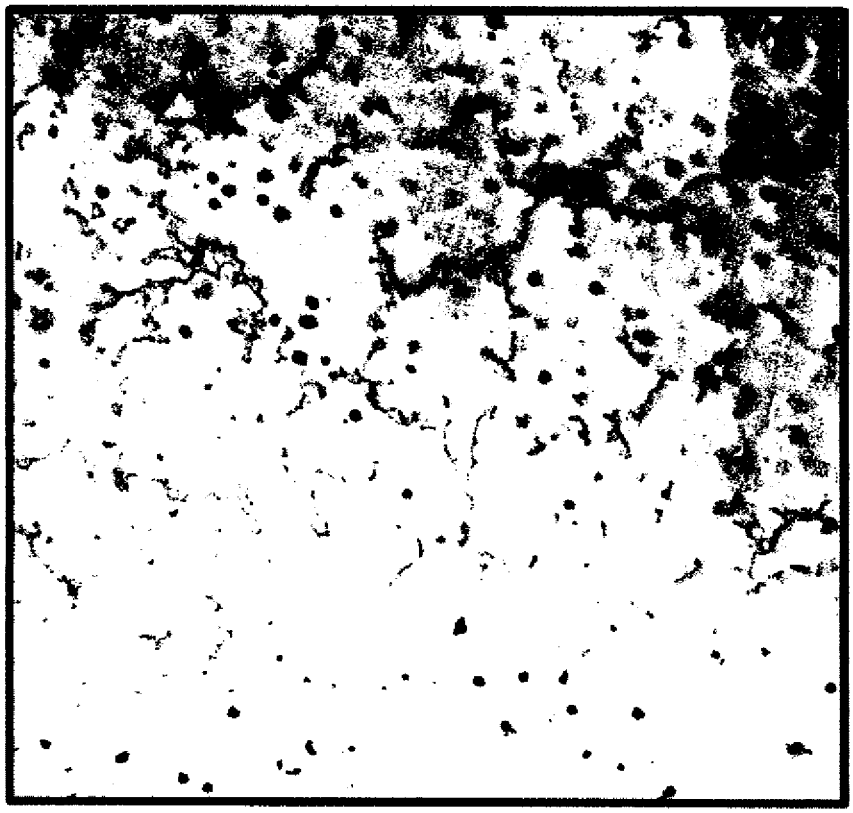
Figure 22:
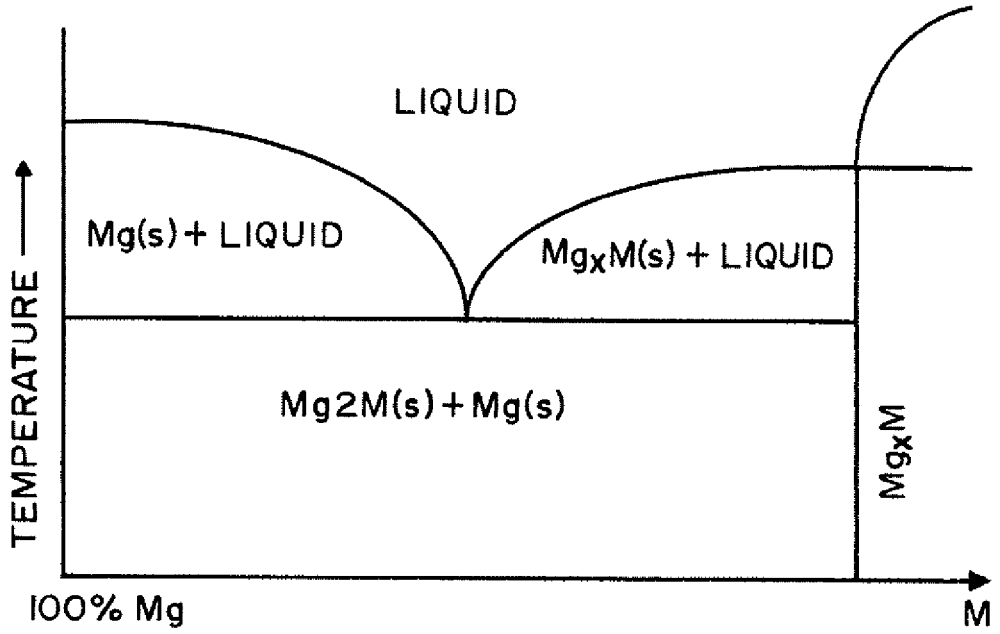

The dissolvable or degradable metal generally includes a base metal or base metal alloy having discrete particles disbursed in the base metal or base metal alloy. The discrete particles are generally uniformly dispersed through the base metal or base metal alloy using techniques such as, but not limited to, thixomolding, stir casting, mechanical agitation, electrowetting, ultrasonic dispersion and/or combinations of these methods; however, this is not required. The degradable metal can be designed to corrode at the grains in the degradable metal, at the grain boundaries of the degradable metal, and/or the location of the particle additions in the degradable metal. The particle size, particle morphology and particle porosity of the particles can be used to affect the rate of corrosion of the degradable metal. The particles can optionally have a surface area of 0.001 m$^2$/g-200 m$^2$/g (and all values and ranges therebetween). The base metal of the degradable metal can include magnesium, zinc, titanium, aluminum, iron, or any combination or alloys thereof. The particles can include, but is not limited to, beryllium, magnesium, aluminum, zinc, cadmium, iron, tin, copper, titanium, lead, nickel, carbon, calcium, boron carbide, and any combinations and/or alloys thereof. In one non-limiting specific embodiment, the degradable metal includes a magnesium and/or magnesium alloy as the base metal or base metal alloy, and nanoparticle additions. In another non-limiting specific embodiment, the degradable metal includes aluminum and/or aluminum alloy as the base metal or base metal alloy, and nanoparticle additions. The particles in the degradable metal are generally less than about 1 μm in size (e.g., 0.00001-0.999 μm and all values and ranges therebetween), typically less than about 0.5 μm, more typically less than about 0.1 μm, and typically less than about 0.05 μm, still more typically less than 0.005 μm, and yet still more typically no greater than 0.001 μm (nanoparticle size). The total content of the particles in the degradable metal is generally about 0.01-70 wt. % (and all values and ranges therebetween), typically about 0.05-49.99 wt. %, more typically about 0.1-40 wt. %, still more typically about 0.1-30 wt. %, and even more typically about 0.5-20 wt. %. When more than one type of particle is added in the degradable metal, the content of the different types of particles can be the same or different. When more than one type of particle is added in the degradable metal, the shape of the different types of particles can be the same or different. When more than one type of particle is added in the degradable metal, the size of the different types of particles can be the same or different. After the mixing process is completed, the molten magnesium or magnesium alloy and the particles that are mixed in the molten magnesium or magnesium alloy are cooled to form a solid component. Such a formation in the melt is called in situ particle formation as illustrated in FIGS. 19-21. Such a process can be used to achieve a specific galvanic corrosion rate in the entire magnesium composite and/or along the grain boundaries of the magnesium composite. The final magnesium composite can also be enhanced by heat treatment as well as deformation processing (such as extrusion, forging, or rolling) to further improve the strength of the final composite over the as-cast material; however, this is not required. The deformation processing can be used to achieve strengthening of the magnesium composite by reducing the grain size of the magnesium composite. Achievement of in situ particle size control can be achieved by mechanical agitation of the melt, ultrasonic processing of the melt, controlling cooling rates, and/or by performing heat treatments. In situ particle size can also or alternatively be modified by secondary processing such as rolling, forging, extrusion and/or other deformation techniques. A smaller particle size can be used to increase the dissolution rate of the magnesium composite. An increase in the weight percent of the in situ formed particles or phases in the magnesium composite can also or alternatively be used to increase the dissolution rate of the magnesium composite. A phase diagram for forming in situ formed particles or phases in the magnesium composite is illustrated in FIG. 22.

Figure 16:
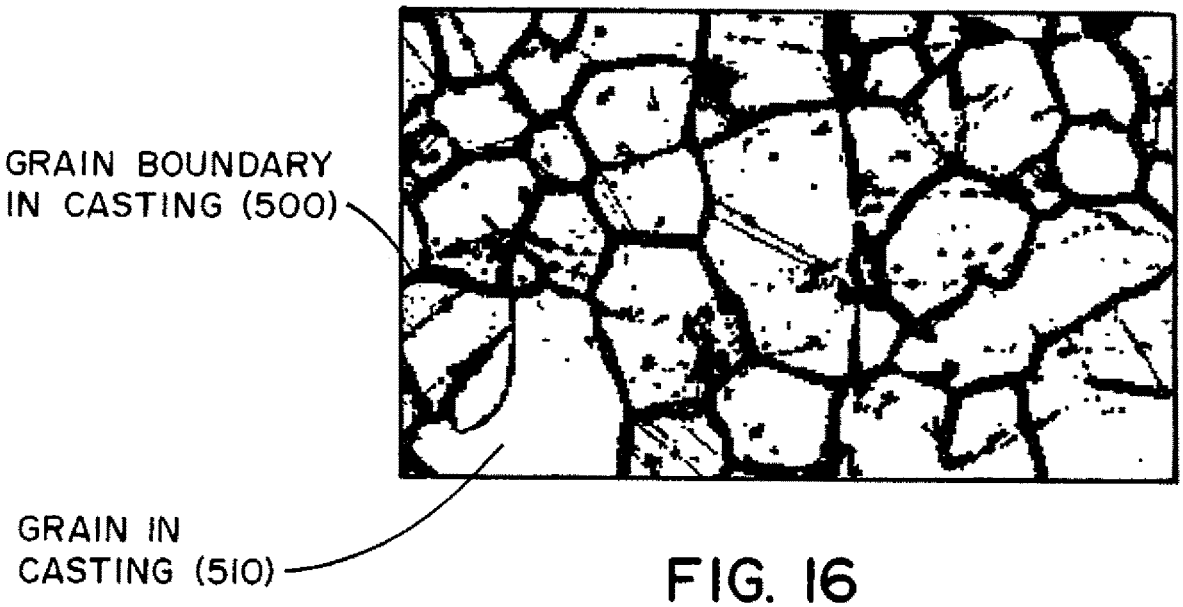
FIG. 16 illustrates a typical cast microstructure with grain boundaries (500) separating grains (510)
Figure 17:
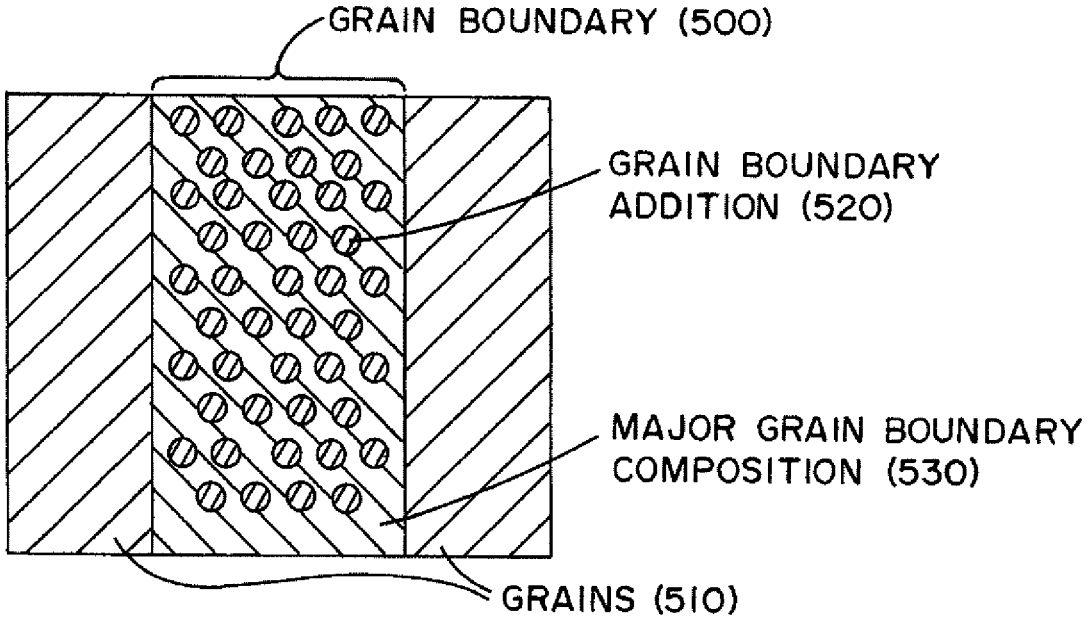
FIG. 17 illustrates a detailed grain boundary (500) between two grains (500) wherein there is one non-soluble grain boundary addition (520) in a majority of grain boundary composition (530) wherein the grain boundary addition, the grain boundary composition, and the grain all have different galvanic potentials and different exposed surface areas.
Figure 18:
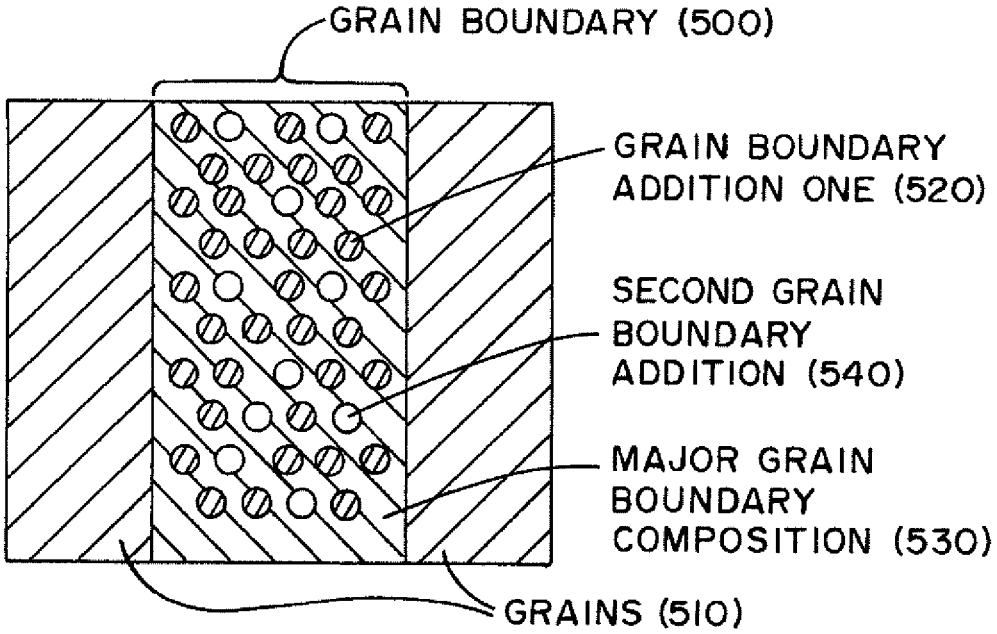
FIG. 18 illustrates a detailed grain boundary (500) between two grains (510) wherein there are two non-soluble grain boundary additions (520 and 540) in a majority of grain boundary composition (530) wherein the grain boundary additions, the grain boundary composition, and the grain all have different galvanic potentials and different exposed surface areas.

The degradable metal can be designed to corrode at the grains in the degradable metal, at the grain boundaries of the degradable metal, and/or the location of the particle additions in the degradable metal e depending on selecting where the particle additions fall on the galvanic chart. For example, if it is desired to promote galvanic corrosion only along the grain boundaries (500) of the grains (510) as illustrated in FIGS. 16-18, a degradable metal can be selected such that one galvanic potential exists in the base metal or base metal alloy where its major grain boundary alloy composition (530) will be more anodic as compared to the matrix grains (i.e., grains that form in the base metal or base metal alloy) located in the major grain boundary, and then a particle addition (520) will be selected which is more cathodic as compared to the major grain boundary alloy composition. This combination will cause corrosion of the material along the grain boundaries, thereby removing the more anodic major grain boundary alloy (530) at a rate proportional to the exposed surface area of the cathodic particle additions (520) to the anodic major grain boundary alloy (530).

If a slower corrosion rate of the degradable metal is desired, two or more particle additions can be added to the degradable metal to be deposited at the grain boundary as illustrated in FIG. 18. If the second particle (540) is selected to be the most anodic in the degradable metal, the second particle will first be corroded, thereby generally protecting the remaining components of the degradable metal based on the exposed surface area and galvanic potential difference between second particle and the surface area and galvanic potential of the most cathodic system component. When the exposed surface area of the second particle (540) is removed from the system, the system reverts to the two previous embodiments described above until more particles of second particle (540) are exposed. This arrangement creates a mechanism to retard corrosion rate with minor additions of the second particle component.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A centralizing device configured to be placed on, attached to, or combinations thereof an outside surface of a bore member and to centralize the bore member in a wellbore, cavity, or tube, said centralizing device includes a body, an active material that includes one or more materials selected from the group consisting of an expandable material and a degradable material, and a first and second well bore wall engagement members positioned in a non-deployed position, said first and second well bore wall engagement members including one or more structures selected from the group consisting of slat, wing, bow, leave, ribbon, extension and rib, said first well bore wall engagement members configured to move from said non-deployed position to a deployed position, said active material configured to cause or to enable said first and second well bore wall engagement members to move from said non-deployed position to said deployed position to thereby cause an outer surface of said first and second well bore wall engagement members to engage the wellbore, cavity, or tube and cause the bore member to be centralized in the wellbore, cavity, or tube, a maximum outer perimeter of said centralizing device is greater in size when said first and second well bore wall engagement members are in said deployed position as compared to when said first and second well bore wall engagement members are in said non-deployed position, at least a portion of said outer surface of said first and second well bore wall engagement members absent said active material, at least a portion of said first and second well bore wall engagement members formed of material that is non-expandable.

2. The centralizing device as defined in claim 1, wherein said active material includes said expandable material, said expandable material configured to increase in volume when activated, said increase in volume of said expandable material configured to provide a force that causes said one or more well bore wall engagement members to move or deform and thereby move from said non-deployed position to said deployed position.

3. The centralizing device as defined in claim 1, wherein said active material includes said degradable material, said degradable material configured to degrade or dissolve when activated, said degradation or dissolving of said degradable material configured to cause or allow said one or more well bore wall engagement members to move from said non-deployed position to said deployed position.

4. The centralizing device as defined in claim 1, wherein said first well bore wall engagement members is biased in said deployed position.

5. The centralizing device as defined in claim 1, wherein said maximum outer perimeter of said centralizing device is at least 5% greater in size when said first well bore wall engagement members is in said deployed position as compared to when said one or more well bore wall engagement members are in said non-deployed position.

6. The centralizing device as defined in claim 1, wherein said outer surface of said first well bore wall engagement members is absent said active material.

7. The centralizing device as defined in claim 1, wherein said first well bore wall engagement members is at least partially formed of said active material.

8. The centralizing device as defined in claim 1, wherein said expandable material is configured to expand less than 1 vol. % in said well bore prior to being activated.

9. The centralizing device as defined in claim 1, wherein said degradable material is configured to degrade less than 1 vol. % in said well bore prior to being activated.

10. The centralizing device as defined in claim 1, wherein said first well bore wall engagement members is formed of a bendable metal material and said expandable material is connected to at least a portion of said bendable metal material, said expandable material is configured to cause said bendable metal material to bend when said expandable material is activated.

11. The centralizing device as defined in claim 1, wherein said expandable material is connected to a section of said bendable metal material and said expansion of said expandable material causes said bendable metal material to expand or bow radially outward.

12. The centralizing device as defined in claim 1, wherein said body of said centralizing device includes first and second body sections, said first well bore wall engagement members and a second well bore wall engagement member are connected to one or both of said first and second body sections and at least partially extending between said first and second body sections, said first and second body sections and said first and second well bore wall engagement members forming a cavity in said centralizing device that extends along a longitudinal length of said centralizing device, said first and second well bore wall engagement member are spaced from one another, said cavity configured to enable said bore member to be positioned in said cavity when said centralizing device is positioned on said bore member.

13. The centralizing device as defined in claim 1, wherein said first well bore wall engagement members lies flat when said first well bore wall engagement members is in said non-deployed position.

14. The centralizing device as defined in claim 1, wherein said centralizing device includes a retaining member that is at least partially formed of said degradable material, said retaining member configured to maintain said first well bore wall engagement members in said non-deployed position.

15. The centralizing device as defined in claim 1, wherein said retaining member includes one or more devices selected from the group consisting of a sleeve, locking ring, wire, screw, and/or pin.

16. The centralizing device as defined in claim 1, wherein said first well bore wall engagement members is biased in said deployed position and a degradation or dissolving of said retaining member causes said retaining member to weaken or to be removed from said body of said centralizing device and thereby resulting in said first well bore wall engagement members to move to said deployed position.

17. The centralizing device as defined in claim 1, wherein said first well bore wall engagement member engages with or is partially formed of said degradable material, said first well bore wall engagement member is configured to move from said deployed position to a partially or fully non-deployed position when said degradable material partially of fully degrades or dissolves.

18. The centralizing device as defined in claim 1, wherein at least a portion of said active material is coated with a coating material that is formulated to delay activation of said active material.

19. The centralizing device as defined in claim 18, wherein said coating material includes one or more materials selected from the group consisting of polyester, polyether, polyamine, polyamide, polyacetal, polyvinyl, polyureathane, epoxy, polysiloxane, polycarbosilane, polysilane, and polysulfone.

20. The centralizing device as defined in claim 1, wherein said expandable material includes reactive particles dispersed in a polymer matrix.

21. The centralizing device as defined in claim 20, wherein said reactive particles have a concentration of 20-60 vol. % in said polymer matrix, said reactive particles formulated to react with water to form oxides, hydroxides, or carbonates and to expand in volume at least 50 vol. % when reacted with said water.

22. The centralizing device as defined in claim 20, wherein said reactive particles include one or more materials selected from the group consisting of MgO, CaO, CaC, Mg, Ca, Li, Na, Fe, Al, Si, P, Zn, Ti, $Li_2O$, $K_2O$, $Na_2O$, borates, aluminosilicates, and layered compounds.

23. The centralizing device as defined in claim 20, wherein said polymer matrix includes one or more polymers selected from the group consisting of polyester, nylon, polycarbonate, polysulfone, polyurea, polyimide, silanes, carbosilanes, silicone, polyarylate, polyimide, PEEK, PEI, epoxy, PPS, PPSU, and phenolic compounds.

24. The centralizing device as defined in claim 20, wherein said expandable material includes a catalyst that is formulated to accelerate reaction of said reactive particles.

25. The centralizing device as defined in claim 20, wherein said expandable material includes strengthening fillers, diluting fillers, or combinations thereof that include one or more materials selected from the group consisting of fumed silica, silica, glass fibers, carbon fibers, carbon nanotubes, and other finely divided inorganic material.

26. The centralizing device as defined in claim 20, wherein said polymer matrix has a preselected creep rate to relax and remove loading on at least one of said well bore wall engagement members over a period of time such that a force that is used to cause said at least one of said well bore wall engagement member to move to said deployed position reduces over time.

27. The centralizing device as defined in claim 1, wherein said degradable material includes a base metal material and a plurality of particles disbursed in said degradable material, said particles constitute about 0.1-40 wt. % of said degradable material, said particles have a different galvanic potential from said base metal material, said base metal material is a magnesium alloy or an aluminum alloy, said particles including one or more materials selected from the group consisting of iron, copper, titanium, zinc, tin, cadmium, calcium, lead, beryllium, nickel, carbon, iron alloy, copper alloy, titanium alloy, zinc alloy, tin alloy, cadmium alloy, lead alloy, beryllium alloy, and nickel alloy.

28. The centralizing device as defined in claim 27, wherein said base metal material includes a majority weight percent magnesium.

29. The centralizing device as defined in claim 27, wherein said particles have a particle size of less than 1 μm.

30. The centralizing device as defined in claim 29, wherein said particles include one or more materials selected from the group consisting of iron, beryllium, copper, titanium, nickel, and carbon.

31. A centralizing device configured to be placed on, attached to, or combinations thereof an outside surface of a bore member and to centralize the bore member in a wellbore, cavity, or tube, said centralizing device includes a body, an active material, and first and second well bore wall engagement members, said first and second well bore wall engagement members positioned in a non-deployed position, said first and second well bore wall engagement members configured to move from said non-deployed position to a deployed position, said active material configured to cause or enable said first and second well bore wall engagement members to move from said non-deployed position to said deployed position, a maximum outer perimeter of said centralizing device is greater in size when said first and second well bore wall engagement members are in said deployed position as compared to when said first and second well bore wall engagement members are in said non-deployed position, said body of said centralizing device includes first and second body sections and said first and second well bore wall engagement members connected between said first and second body sections, said first and second end portions spaced apart from one another along a longitudinal axis of said centralizing device, said first and second well bore wall engagement members spaced apart from one another, said first and second body sections and said first and second well bore wall engagement members forming a cavity in said centralizing device that extends along a longitudinal length of said centralizing device, said cavity is configured to enable said bore member to be positioned in said cavity when said centralizing device is positioned on said bore member, at least a portion of said outer surface of said first and second well bore wall engagement members absent said active material, at least a portion of said first and second well bore wall engagement members formed of material that is non-expandable.

32. The centralizing device as defined in claim 31, wherein said active material includes reactive particles dispersed in a polymer matrix, said reactive particles have a concentration of 20-60 vol. % in said polymer matrix, said reactive particles formulated to react with water to form oxides, hydroxides, or carbonates and to expand in volume at least 50 vol. % when reacted with said water.

33. The centralizing device as defined in claim 32, wherein said reactive particles include one or more material selected from the group consisting of MgO, CaO, CaC, Mg, Ca, Li, Na, Fe, Al, Si, P, Zn, Ti, $Li_2O$, $K_2O$, $Na_2O$, borates, and aluminosilicates.

34. The centralizing device as defined in claim 33, wherein said polymer matrix includes one or more polymers selected from the group consisting of polyester, nylon, polycarbonate, polysulfone, polyurea, polyimide, silanes, carbosilanes, silicone, polyarylate, polyimide, PEEK, PEI, epoxy, PPS, PPSU, and phenolic compounds.

35. The centralizing device as defined in claim 31, wherein said first and second well bore wall engagement members each include a top and bottom surface, said top surface configured to engage an inner wall of the wellbore, a cavity, or a tube when said first and second well bore wall engagement members move to said deployed position, said bottom surface includes a recess, said recess includes said active material, said active material is absent from said top surface of said first and second well bore wall engagement members.

36. The centralizing device as defined in claim 34, wherein said first and second well bore wall engagement members each include a top and bottom surface, said top surface configured to engage an inner wall of the wellbore, a cavity, or a tube when said first and second well bore wall engagement members move to said deployed position, said bottom surface includes a recess, said recess includes said active material, said active material is absent from said top surface of said first and second well bore wall engagement members.

* * * * *